US009989074B2

(12) United States Patent
Nishijima et al.

(10) Patent No.: US 9,989,074 B2
(45) Date of Patent: Jun. 5, 2018

(54) EJECTOR

(71) Applicant: DENSO CORPORATION, Kariya, Aichi-pref. (JP)

(72) Inventors: Haruyuki Nishijima, Kariya (JP); Kenta Kayano, Kariya (JP); Yoshiaki Takano, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 106 days.

(21) Appl. No.: 14/898,695

(22) PCT Filed: May 27, 2014

(86) PCT No.: PCT/JP2014/002786
§ 371 (c)(1),
(2) Date: Dec. 15, 2015

(87) PCT Pub. No.: WO2014/203462
PCT Pub. Date: Dec. 24, 2014

(65) Prior Publication Data

US 2016/0186783 A1 Jun. 30, 2016

(30) Foreign Application Priority Data

Jun. 18, 2013 (JP) ..... 2013-127578

(51) Int. Cl.
*F04F 5/20* (2006.01)
*F04F 5/46* (2006.01)
(Continued)

(52) U.S. Cl.
CPC ..... *F04F 5/20* (2013.01); *F04F 5/46* (2013.01); *F25B 1/08* (2013.01); *F25B 5/02* (2013.01);
(Continued)

(58) Field of Classification Search
CPC ..... F04F 5/20; F04F 5/46; F25B 1/08; F25B 41/00; F25B 5/02; F25B 2341/0011
See application file for complete search history.

(56) References Cited

U.S. PATENT DOCUMENTS

2004/0007013 A1 1/2004 Takeuchi
2004/0172966 A1 9/2004 Ozaki et al.
(Continued)

FOREIGN PATENT DOCUMENTS

EP 2080967 A1 * 7/2009
EP 2080967 A1 * 7/2009 ..... F25D 41/00
(Continued)

OTHER PUBLICATIONS

International Search Report and Written Opinion (in Japanese with English Translation) for PCT/JP2014/002786, dated Aug. 19, 2014; ISA/JP.
(Continued)

*Primary Examiner* — Emmanuel Duke
(74) *Attorney, Agent, or Firm* — Harness, Dickey & Pierce, P.L.C.

(57) ABSTRACT

A mixing portion that is formed in an area from a refrigerant injection port of a nozzle portion to an inlet section of a diffuser portion in an internal space of a body portion of an ejector, that mixes an injection refrigerant injected from the refrigerant injection port and a suction refrigerant suctioned from a refrigerant suction port is provided. A distance from the refrigerant injection port to the inlet section in the mixing portion is determined such that a flow velocity of the refrigerant flowing into the inlet section of the diffuser portion becomes lower than or equal to a two-phase sound velocity. A shock wave that is generated at a time that a
(Continued)

mixed refrigerant is shifted from a supersonic velocity state to a subsonic velocity state is generated in the mixing portion.

10 Claims, 17 Drawing Sheets

(51) Int. Cl.
*F25B 5/02* (2006.01)
*F25B 41/00* (2006.01)
*F25B 1/08* (2006.01)

(52) U.S. Cl.
CPC ..... *F25B 41/00* (2013.01); *F25B 2341/0011* (2013.01)

(56) References Cited

U.S. PATENT DOCUMENTS

| | | | | |
|---|---|---|---|---|
| 2004/0255610 | A1* | 12/2004 | Nishijima | F25B 41/00 62/500 |
| 2006/0266072 | A1* | 11/2006 | Takeuchi | F25B 40/00 62/500 |
| 2007/0028630 | A1* | 2/2007 | Yamada | F25B 5/00 62/170 |
| 2009/0229305 | A1* | 9/2009 | Yamada | F25B 41/00 62/500 |
| 2010/0175422 | A1* | 7/2010 | Yamada | F25B 41/00 62/512 |
| 2013/0111944 | A1* | 5/2013 | Wang | F25B 41/00 62/500 |
| 2016/0116195 | A1 | 4/2016 | Nishijima et al. | |

FOREIGN PATENT DOCUMENTS

| | | | | |
|---|---|---|---|---|
| JP | S60108600 | A | | 6/1985 |
| JP | 2004044412 | A | | 2/2004 |
| JP | 2004270460 | A | | 9/2004 |
| JP | 2006292351 | A | | 10/2006 |
| JP | 2007032945 | A | | 2/2007 |
| JP | 2009133624 | A | | 6/2009 |
| JP | 2012149790 | A | | 8/2012 |
| JP | 2013068199 | A | | 4/2013 |
| KR | 20020037606 | A | * | 11/2000 |
| KR | 20020037606 | A | * | 5/2002 |
| WO | WO-2014156075 | A1 | | 10/2014 |
| WO | WO-2014203461 | A1 | | 12/2014 |

OTHER PUBLICATIONS

Shigeru Matsuo et al., "Avoidance of Self-excited Oscillation of Condensation Shock Wave Using a Double Slot", Transactions of the Japan Society of Mechanical Engineers (Series B), vol. 68, No. 676 (Dec. 2002), pp. 3338-3345.

Shigeru Matsuo et al., "Studies Regarding Shock Wave", Transactions of the Japan Society of Mechanical Engineers (Series B), vol. 50, No. 459 (Nov. 1984), pp. 2577-2582.

Shigeru Matsuo et al., "CFD Investigation of Passive Control on Condendsation Shock Wave", Transactions of the Japan Society of Mechanical Engineers (Series B), vol. 67, No. 660 (Aug. 2001), pp. 1952-1959.

* cited by examiner

EJECTOR

CROSS REFERENCE TO RELATED APPLICATIONS

This application is a U.S. National Phase Application under 35 U.S.C. 371 of International Application No. PCT/JP2014/002786 filed on May 27, 2014 and published in Japanese as WO 2014/203462 A1 on Dec. 24, 2014. This application is based on and claims the benefit of priority from Japanese Patent Application No. 2013-127578 filed on Jun. 18, 2013. The entire disclosures of all of the above applications are incorporated herein by reference.

TECHNICAL FIELD

The present disclosure relates to an ejector that decompresses a fluid and draws the fluid by a suction action of an injected fluid injected at a high velocity.

BACKGROUND ART

Conventionally, a vapor compressional refrigeration cycle device that includes an ejector (hereinafter referred to as an ejector-type refrigeration cycle) has been known.

In this type of the ejector-type refrigeration cycle, a refrigerant flowing out of an evaporator is suctioned by an suction action of a high-velocity injection refrigerant injected from a nozzle portion of the ejector, pressure of a mixed refrigerant of the injection refrigerant and the suction refrigerant is increased by converting kinetic energy of the mixed refrigerant to pressure energy in a diffuser portion (i.e., a pressure increase portion) of the ejector, and the mixed refrigerant flows out to a intake side of a compressor.

In this way, in the ejector-type refrigeration cycle, consumed power by the compressor is reduced, and a coefficient of performance (COP) of the cycle is improved in comparison with a general refrigeration cycle device in which refrigerant evaporation pressure in an evaporator is substantially equal to suction refrigerant pressure in a compressor.

Furthermore, for example, Patent Literature 1 discloses a specific configuration of such an ejector-type refrigeration cycle that includes two evaporators, in which a refrigerant flowing out of the evaporator on a high refrigerant evaporation pressure side flows into a nozzle portion of an ejector, and in which a refrigerant flowing out of the evaporator on a low refrigerant evaporation pressure side is suctioned by a suction action of the injection refrigerant.

PRIOR ART LITERATURES

Patent Literature

Patent Literature 1: JP 2012-149790 A

SUMMARY OF INVENTION

However, according to examination of the inventors of the subject application, there is a case where, when the ejector-type refrigeration cycle of Patent Literature 1 is actually operated, a diffuser portion of the ejector is incapable of exerting desired refrigerant pressure increasing performance, and an effect in improving the COP that is achieved by including the ejector cannot be obtained sufficiently.

In view of the above, the inventors of the subject application investigated a cause and understood that, in the case where a gas-phase refrigerant flowing out of the evaporator flows into the nozzle portion of the ejector as in the ejector-type refrigeration cycle of Patent Literature 1, (i) the mixed refrigerant of the injection refrigerant and the suction refrigerant become a gas-liquid two-phase refrigerant having a high quality, and (ii) the gas-phase refrigerant is condensed while pressure thereof is decreasing in a refrigerant passage formed in the nozzle portion.

In view of the above point, the present disclosure has a purpose of restricting deterioration of refrigerant pressure increasing performance of an ejector that makes a refrigerant flowing out of an evaporator flow into a nozzle portion.

In detail, the present disclosure has a purpose of restricting the deterioration of the refrigerant pressure increasing performance by stabilizing the refrigerant pressure increasing performance in the ejector that makes the refrigerant flowing out of the evaporator flow into the nozzle portion.

In addition, the present disclosure has the other purpose of restricting the deterioration of the refrigerant pressure increasing performance by reducing energy loss of the refrigerant in the nozzle portion of the ejector that makes the refrigerant flowing out of the evaporator flow into the nozzle portion.

According to what has been described above, the distance from the refrigerant injection port in the mixing portion to the inlet section of the pressure increase portion is determined such that the flow velocity of the refrigerant flowing into the inlet section becomes lower than or equal to the two-phase sound velocity. Thus, the shock wave that is generated at a time that the mixed refrigerant is shifted from a supersonic velocity state to a subsonic velocity state can be generated in the mixing portion.

Therefore, generation of the shock wave in the pressure increase portion can be restricted, and the flow velocity of the mixing refrigerant flowing through the pressure increase portion can be restricted from becoming unstable by an action of the shock wave. As a result, in the ejector that makes the refrigerant flowing out of the evaporator flow into the nozzle portion, refrigerant pressure increasing performance in the pressure increase portion can be stabilized, and deterioration of the refrigerant pressure increasing performance can be restricted.

According to what has been described above, the injecting section is provided at the lowermost stream side of the refrigerant passage that is formed in the nozzle portion, and the injection refrigerant to be injected to the mixing portion is expanded freely. Thus, the refrigerant can be accelerated in the mixing portion without providing a flare section or the like as the refrigerant passage, the refrigerant passage cross-sectional area of which gradually increases toward the downstream side in a refrigerant flow direction.

Therefore, loss of kinetic energy of the refrigerant flowing through the refrigerant passage can be restricted by reducing wall surface friction between the refrigerant and the refrigerant passage, and the flow velocity of the injection refrigerant can thus be restricted from being reduced. As a result, in the ejector that makes the refrigerant flowing out of the evaporator flow into the nozzle portion, the deterioration of the refrigerant pressure increasing performance can be restricted by reducing the energy loss of the refrigerant in the nozzle portion.

The "expanding angle in an axial cross section of the injecting section is larger than or equal to 0°" means that the injecting section has a shape (i.e., a truncated cone shape), in which the refrigerant passage cross-sectional area gradually increases toward a refrigerant flow direction in the case where the expanding angle is larger than 0°, and means that the injecting section has a shape (i.e., a columnar shape), in which the refrigerant passage cross-sectional area is fixed in the case where the expanding angle is 0°.

DESCRIPTION OF EMBODIMENTS

Figure 1:
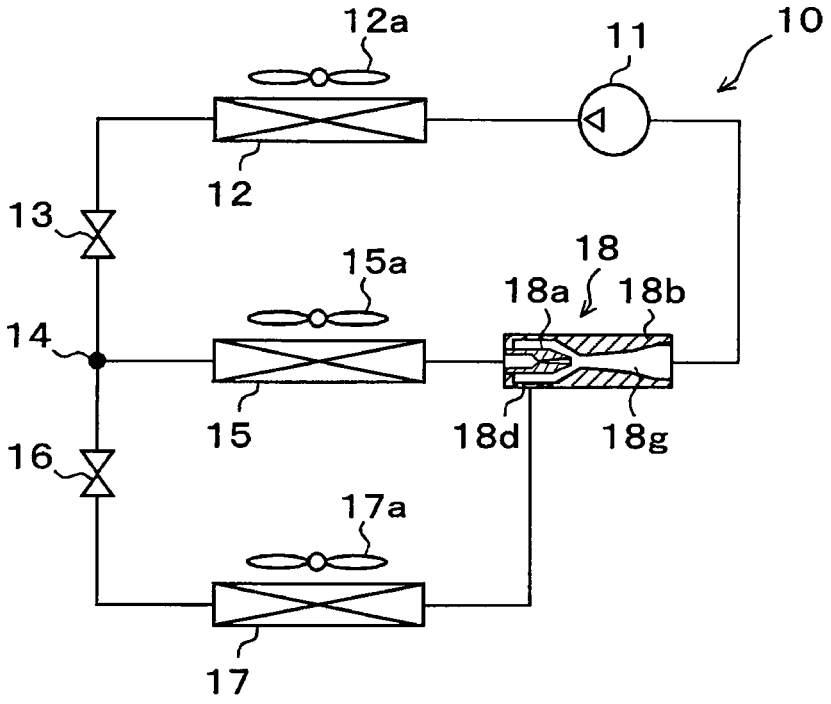
FIG. 1 is an overall configuration diagram illustrating an ejector-type refrigeration cycle of a first embodiment.

In a conventional ejector-type refrigeration cycle, a refrigerant flowing out of an evaporator is suctioned as a suction refrigerant by an suction action of a high-velocity injection refrigerant injected from a nozzle portion of an ejector, pressure of a mixed refrigerant of the injection refrigerant and the suction refrigerant is increased by converting kinetic energy of the mixed refrigerant to pressure energy in a diffuser portion (i.e., a pressure increase portion), and the mixed refrigerant flows out to a intake side of a compressor.

In this way, in the ejector-type refrigeration cycle, consumed power by the compressor is reduced, and a coefficient of performance (COP) of the cycle is improved in comparison with a general refrigeration cycle device in which refrigerant evaporation pressure in an evaporator is substantially equal to suction refrigerant pressure in a compressor.

For example, Patent Literature 1 discloses an ejector-type refrigeration cycle that includes two evaporators, in which a refrigerant flowing out of the evaporator on a high refrigerant evaporation pressure side flows into a nozzle portion of an ejector, and in which a refrigerant flowing out of the evaporator on a low refrigerant evaporation pressure side is suctioned by a suction action of an injection refrigerant.

However, according to examination of the inventors of the subject application, there is a case where, when the ejector-type refrigeration cycle of Patent Literature 1 is actually operated, a diffuser portion of the ejector is incapable of exerting desired refrigerant pressure increasing performance, and an effect in improving the COP that is achieved by including the ejector cannot be obtained sufficiently.

In view of the above, the inventors of the subject application investigated a cause and understood that, in a configuration in which a gas-phase refrigerant that flowing out of the evaporator flows into the nozzle portion of the ejector as in the ejector-type refrigeration cycle of Patent Literature 1, (a) the mixed refrigerant of the injection refrigerant and the suction refrigerant become a gas-liquid two-phase refrigerant having a high quality, and (b) the gas-phase refrigerant is condensed while pressure thereof is decreasing in a refrigerant passage formed in the nozzle portion.

(a) The Mixed Refrigerant of the Injection Refrigerant and the Suction Refrigerant Becomes the Gas-Liquid Two-Phase Refrigerant with the High Quality A description will be made on a reason why the diffuser portion of the ejector is incapable of exerting the desired refrigerant pressure increasing performance in the case where the mixed refrigerant of the injection refrigerant and the suction refrigerant becomes the gas-liquid two-phase refrigerant with the high quality.

When the mixed refrigerant is the gas-liquid two-phase refrigerant with the relatively high quality x (i.e., the gas-liquid two-phase refrigerant of which quality x is higher than or equal to 0.8), a shock wave is generated in the vicinity of the diffuser portion or in the diffuser portion by the gas-liquid two-phase refrigerant. Accordingly, the refrigerant pressure increasing performance in the diffuser portion of the ejector becomes unstable.

The shock wave is generated when a flow velocity of a two-phase fluid in a gas-liquid two-phase state is shifted from a value (i.e., a supersonic velocity state) higher than or equal to a two-phase sound velocity $\alpha h$ to a value (i.e., a subsonic velocity state) lower than or equal to the two-phase sound velocity $\alpha h$.

Here, the two-phase sound velocity $\alpha h$ is a sound velocity of a fluid in a gas-liquid mixed state in which a gas-phase fluid and a liquid-phase fluid are mixed, and is defined by the following formula F1.

$$\alpha h=[P/\{\alpha\times(1-\alpha)\times\rho l\}]0.5 \quad \text{(F1)}$$

α in the formula F1 is a void fraction and indicates a capacity ratio of voids (air bubbles) contained per unit volume. In detail, the void fraction a is defined by the following formula F2.

$$\alpha = x/\{x+(\rho g/\rho l)\times(1-x)\} \quad \text{(F2)}$$

In addition, ρg in the formulae F1, F2 is gas-phase fluid density, ρl is liquid-phase fluid density, and P is pressure of the two-phase fluid.

A cause of the unstable refrigerant pressure increasing performance in the diffuser portion of the ejector by the shock wave will be described by using FIG. 20, FIG. 21. In upper portions of FIG. 20, FIG. 21, axial cross-sectional views of a general ejector are schematically depicted. In order to clarify the illustration, in FIG. 20, FIG. 21, portions that exert the same or equivalent functions as those of an ejector 18 in this disclosure, which will be described below in the following embodiments, are denoted by the same reference signs as those of the ejector 18 in this disclosure.

The gas-liquid two-phase refrigerant with the relatively low quality x (e.g., the gas-liquid two-phase refrigerant of which quality x is lower than or equal to 0.5) flows into a nozzle portion 18*a* of the ejector 18. In this case, the refrigerant expands in an isentropic manner in the nozzle portion 18*a*. Thus, the quality x of the refrigerant that is immediately before being injected from a refrigerant injection port 18*c* of the nozzle portion 18*a* becomes a lower value than the quality x of the refrigerant that flows into the nozzle portion 18*a*.

The injection refrigerant that is injected from the refrigerant injection port 18*c* of the nozzle portion 18*a* is mixed with the suction refrigerant in the gas-phase state, and thus the quality x thereof is abruptly increased while the flow velocity thereof is reduced. In this way, as indicated by a bold broken line in FIG. 20, the two-phase sound velocity αh of the mixed refrigerant of the injection refrigerant and the suction refrigerant is also abruptly increased.

As a result, in the case where the gas-liquid two-phase refrigerant with the relatively low quality x flows into the nozzle portion 18*a*, the flow velocity of the mixed refrigerant immediately after being injected from the refrigerant injection port 18*c* becomes lower than the two-phase sound velocity αh. The shock wave that is generated at a time that the flow velocity of the two-phase refrigerant is shifted from the supersonic velocity state to the subsonic velocity state is generated in the extreme vicinity of the refrigerant injection port 18*c* of the nozzle portion 18*a*. Thus, the shock wave has a small influence on the refrigerant pressure increasing performance of a diffuser portion 18*g*.

Next, in the case where the gas-liquid two-phase refrigerant with the relatively high quality x (e.g., the gas-liquid two-phase refrigerant of which quality x is higher than or equal to 0.8) flows into the nozzle portion 18*a*, the quality x of the refrigerant that is immediately before being injected from the refrigerant injection port 18*c* of the nozzle portion 18*a* is also high. Accordingly, compared to a case where the gas-liquid two-phase refrigerant with the relatively low quality x flows into the nozzle portion 18*a*, a degree of an increase in the quality x at a time that the injection refrigerant is mixed with the suction refrigerant and becomes the mixed refrigerant is reduced.

Figure 21:
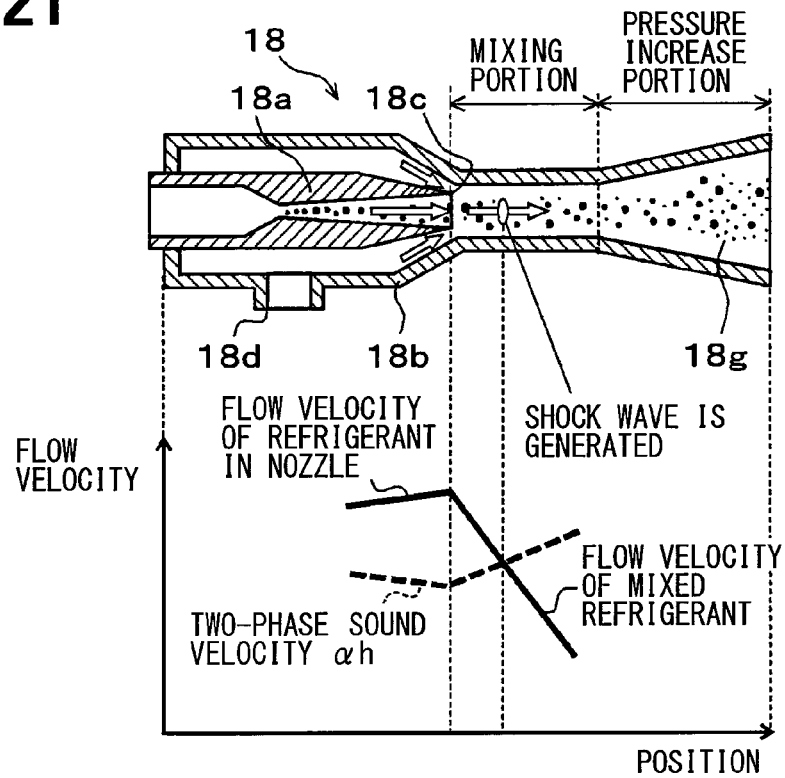
FIG. 21 is an explanatory diagram explaining a position where the shock wave is generated in the ejector during an operation in which a quality of a refrigerant flowing into a nozzle portion is relatively high.

Thus, as indicated by a bold broken line in FIG. 21, a degree of an increase in the two-phase sound velocity αh of the mixed refrigerant is also reduced. Compared to the case where the gas-liquid two-phase refrigerant with the relatively low quality x flows into the nozzle portion 18*a*, a position where a flow velocity of the mixed refrigerant has a lower value than two-phase sound velocity αh (i.e., a position where the shock wave is generated) tends to separate from the refrigerant injection port 18*c*.

When the position where the shock wave is generated separates from the refrigerant injection port 18*c* and moves to the vicinity of an inlet section of the diffuser portion 18*g* or into the diffuser portion 18*g*, the flow velocity of the mixed refrigerant that flows through the diffuser portion 18*g* becomes unstable by an action of the shock wave, and the refrigerant pressure increasing performance in the diffuser portion 18*g* becomes unstable.

As a result, the diffuser portion 18*g* of the ejector 18 is no longer capable of exerting the desired refrigerant pressure increasing performance. In the ejector-type refrigeration cycle of Patent Literature 1, an effect in improving the COP that is achieved by including the ejector cannot be obtained sufficiently. Furthermore, the inventors confirmed that the refrigerant pressure increasing performance tends to be unstable when the quality x of the mixed refrigerant is higher than or equal to 0.8 in the ejector-type refrigeration cycle of Patent Literature 1.

(b) the Gas-Phase Refrigerant is Condensed while Pressure Thereof is Reduced in the Refrigerant Passage that is Formed in the Nozzle Portion.

A description will be made on a reason why the diffuser portion of the ejector is incapable of exerting the desired refrigerant pressure increasing performance when the gas-phase refrigerant is condensed while the pressure thereof is reduced in the refrigerant passage formed in the nozzle portion, that is, as indicated in a pressure reduction process from a point d3 to a point g3 in a Mollier diagram in FIG. 3, which will be described in the embodiment below, when the pressure of the refrigerant is reduced in a manner to cross a saturated gas line by the nozzle portion.

In the case where the pressure of the refrigerant that flows into the nozzle portion is fixed, the flow velocity of the refrigerant that is immediately before being injected from the refrigerant injection port is increased in conjunction with an increase in enthalpy of the refrigerant that flows into the nozzle portion, and wall surface friction between the refrigerant and the refrigerant passage formed in the nozzle portion is increased.

In the general ejector, loss of the kinetic energy at the time that the pressure of the refrigerant is reduced in the nozzle portion is recovered by suctioning the refrigerant from a refrigerant suction port by the suction action of the injection refrigerant. At this time, a recovered energy amount (i.e., a reduced amount of the enthalpy indicated by Δiej in FIG. 3) is increased in conjunction with the increase in the enthalpy of the refrigerant that flows into the nozzle portion in the case where the pressure of the refrigerant that flows into the nozzle portion is fixed.

In addition, a maximum value of a flow velocity V of the injection refrigerant that is immediately after being injected from the refrigerant injection port of the nozzle portion is expressed by the following formula F3.

$$V = V0 + (2\times\Delta iej)0.5 \quad \text{(F3)}$$

V0 is an initial velocity of the refrigerant that flows into the nozzle portion.

Accordingly, when the gas-phase refrigerant, the enthalpy of which is higher than that of the gas-liquid two-phase refrigerant, flows into the nozzle portion, the flow velocity V of the injection refrigerant tends to be increased, and the wall surface friction between the refrigerant and the refrigerant passage provided in the nozzle portion also tends to be increased.

Furthermore, when the gas-phase refrigerant that flows through the refrigerant passage provided in the nozzle portion at a high velocity is condensed and becomes the gas-liquid two-phase refrigerant with a high gas-liquid density ratio (e.g., the gas-liquid two-phase refrigerant of which gas-liquid density ratio is higher than or equal to 200), the wall surface friction between the refrigerant and the refrigerant passage is significantly increased and leads to the loss of kinetic energy of the refrigerant. Such loss of kinetic energy reduces the flow velocity of the injection refrigerant, and further deteriorates the refrigerant pressure increasing performance in the diffuser portion.

In view of the above points, in order to restrict the deterioration of the refrigerant pressure increasing performance of the ejector that makes the refrigerant flowing out of the evaporator flow into the nozzle portion, the inventors of the subject application provide an ejector that is formed by adding improvements to the ejector of Patent Literature 1.

First Embodiment

A description will hereinafter be made on a first embodiment by using FIG. 1 to FIG. 4. In this embodiment, an ejector-type refrigeration cycle 10 that includes an ejector 18 is used as a vehicular refrigeration cycle device. More specifically, the ejector-type refrigeration cycle 10 fulfills a function of cooling vehicle cabin inside air to be blown into a vehicle interior and a function of cooling box inside air to be blown into an in-vehicle refrigerator (i.e., cool box) arranged in the vehicle cabin.

In the ejector-type refrigeration cycle 10 depicted in an overall configuration diagram of FIG. 1, a compressor 11 draws a refrigerant, compresses the refrigerant until the refrigerant becomes a high-pressure refrigerant, and discharges the refrigerant. More specifically, the compressor 11 of this embodiment is an electric compressor that is configured by accommodating a fixed-capacity-type compression mechanism and an electric motor driving the compression mechanism in a housing.

Any of various types of compression mechanisms, such as a scroll-type compression mechanism and a pane-type compression mechanism, can be adopted as the compression mechanism. In addition, operation (i.e., number of rotations) of the electric motor is controlled by a control signal output from a control device, which will be described below, and any type of an AC motor and a DC motor can be adopted.

Furthermore, the compressor 11 may be an engine-driven-type compressor that is driven by rotational drive power transmitted from a vehicle traveling engine via a pulley, a belt, and the like. As this type of the engine-driven-type compressor, a variable-capacity-type compressor that can adjust a refrigerant discharging capacity by a change in discharging capacity, a fixed capacity type compressor that adjusts the refrigerant discharge capacity by changing an operation rate of the compressor through connection/disconnection of an electromagnetic clutch, and the like can be adopted.

In addition, an HFC-based refrigerant (more specifically, R-134a) is adopted as the refrigerant in the ejector-type refrigeration cycle 10, and a vapor compression type subcritical refrigeration cycle in which high pressure-side refrigerant pressure does not exceed critical pressure of the refrigerant is configured. Furthermore, refrigerator oil lubricating the compressor 11 is mixed in the refrigerant, and some of the refrigerator oil circulates through the cycle together with the refrigerant.

A refrigerant inlet side of a radiator 12 is connected to a discharge port side of the compressor 11. The radiator 12 is a radiation heat exchanger that radiates heat from a high-pressure refrigerant discharged from the compressor 11 and cools the high-pressure refrigerant by exchanging heat between the high-pressure refrigerant and vehicle outside air (i.e., outside air) blown by a cooling fan 12*a*. The cooling fan 12*a* is an electric blower of which number of rotations (i.e., air volume) is controlled by a control voltage output from the control device.

An inlet side of a high-stage-side throttling device 13 as a first pressure reduction section is connected to a refrigerant outlet side of the radiator 12. The high-stage-side throttling device 13 has a temperature sensing unit that detects a degree of superheat of an outlet side refrigerant of a first evaporator 15 on the basis of a temperature and pressure of the outlet side refrigerant of the first evaporator 15. The high-stage-side throttling device 13 is a temperature type expansion valve that adjusts a cross-sectional area of a throttle passage by a mechanical mechanism such that the degree of superheat of the outlet side refrigerant of the first evaporator 15 falls within a predetermined reference range.

A refrigerant inlet port of a branch part 14 that divides a flow of the refrigerant flowing out of the high-stage-side throttling device 13 is connected to an outlet side of the high-stage-side throttling device 13. The branch part 14 is constructed of a three-way joint that has three inflow/outflow ports. One of the three inflow/outflow ports is set as a refrigerant inlet port, whereas the rest of the two inflow/outflow ports are set as refrigerant outlet ports. Such a three-way joint may be formed by joining pipes with different pipe diameters, or may be formed by providing the plural refrigerant passages to a metal block or a resin block.

A refrigerant inlet side of the first evaporator 15 is connected to one of the refrigerant outlet ports of the branch part 14. The first evaporator 15 is a heat-absorbing heat exchanger that evaporates a low-pressure refrigerant and exerts a heat absorbing effect by exchanging heat between the low-pressure refrigerant, pressure of which has been reduced in the high-stage-side throttling device 13, and the vehicle interior air to be blown into the vehicle cabin from a first blower fan 15*a*. The first blower fan 15*a* is an electric blower of which number of rotations (i.e., air volume) is controlled by a control voltage output from the control device.

An inlet side of a low-stage-side throttling device 16 as a second pressure reduction section is connected to the other refrigerant outlet port of the branch part 14. The low-stage-side throttling device 16 is a fixed-throttle, an opening degree of which is fixed. More specifically, a nozzle, an orifice, a capillary tube, or the like can be adopted.

A refrigerant inlet side of a second evaporator 17 is connected to an outlet side of the low-stage-side throttling device 16. The second evaporator 17 is a heat-absorbing heat exchanger that evaporates the low-pressure refrigerant and exerts a heat absorbing effect by exchanging heat between the low-pressure refrigerant, pressure of which has been reduced in the low-stage-side throttling device 16, and the box inside air to be circulated and blown into the cool box by a second blower fan 17*a*. A basic configuration of the second evaporator 17 is equivalent to that of the first evaporator 15.

Here, the pressure of the refrigerant that flows into the second evaporator 17 is further reduced in the low-stage-side throttling device 16 after being reduced in the high-stage-side throttling device 13. Thus, refrigerant evaporating pressure (i.e., refrigerant evaporating temperature) in the second evaporator 17 is lower than the refrigerant evaporating pressure (i.e., the refrigerant evaporating temperature) in the first evaporator 15. In addition, the second blower fan 17*a* is an electric blower of which number of rotations (i.e., air volume) is controlled by a control voltage output from the control device.

Next, an inlet side of a nozzle portion 18*a* of the ejector 18 is connected to the refrigerant outlet side of the first evaporator 15. The ejector 18 fulfills a function as a decompressor that decompresses the downstream-side refrigerant of the first evaporator 15 and also fulfills a function as a refrigerant circulating section (i.e., a refrigerant transporting section) that draws (i.e., transports) the refrigerant by a suction action of the injection refrigerant injected at a high velocity and makes the refrigerant circulate through the cycle.

A detailed configuration of the ejector 18 will be described by using FIG. 2. The ejector 18 has the nozzle portion 18*a* and a body portion 18*b*. First, the nozzle portion 18*a* is formed of a substantially cylindrical metal (e.g., stainless steel alloy) or the like that is gradually tapered toward a refrigerant flow downstream direction, and decompresses and expands the refrigerant in an isentropic manner in a refrigerant passage (i.e., throttle passage) formed on the inside.

In the refrigerant passage formed in the nozzle portion 18*a*, a throat section (i.e., minimum passage cross-sectional area section) and a flare section are provided. In the throat section, a refrigerant passage cross-sectional area is maximally reduced. In the flare section, the refrigerant passage cross-sectional area gradually increases from the throat section toward a refrigerant injection port 18*c* injecting the refrigerant as the injection refrigerant. That is, the nozzle portion 18*a* of this embodiment is configured as a so-called de Laval nozzle.

According to the nozzle portion 18*a* of this embodiment, the injection refrigerant becomes a gas-liquid two-phase state during a normal operation of the ejector-type refrigeration cycle 10. Furthermore, a flow velocity of the refrigerant that is immediately before being injected from the refrigerant injection port 18*c* becomes a value (in a supersonic velocity state) higher than or equal to the two-phase sound velocity $\alpha h$, which has been described for the above-mentioned formula F1.

Next, the body portion 18*b* is formed of a substantially cylindrical metal (e.g., aluminum) or a resin, functions as a fixing member that supports and fixes the nozzle portion 18*a* on the inside thereof, and forms an outer shell of the ejector 18. More specifically, the nozzle portion 18*a* is fixed by press-fitting or the like so as to be accommodated on the inside of the body portion 18*b* on one end side in the longitudinal direction.

In addition, a portion of an outer circumferential side surface of the body portion 18*b* that corresponds to the outer circumferential side of the nozzle portion 18*a* is formed with a refrigerant suction port 18*d* that is provided to penetrate therethrough and communicate with the refrigerant injection port 18*c* of the nozzle portion 18*a*. The refrigerant suction port 18*d* is a through hole through which the refrigerant flowing out of the second evaporator 17 is suctioned as the suction refrigerant by the suction action of the injection refrigerant into the ejector 18.

Furthermore, on the inside of the body portion 18*b*, a mixing portion 18*e* that mixes the injection refrigerant and the suction refrigerant, a suction passage 18*f* that guides the suction refrigerant to the mixing portion 18*e*, and a diffuser portion 18*g* as a pressure increase portion that increases pressure of the mixed refrigerant that has been mixed in the mixing portion 18*e* are formed.

The suction passage 18*f* is formed by a space between an outer circumferential side near a tip in a tapered shape of the nozzle portion 18*a* and an inner circumferential side of the body portion 18*b*. A refrigerant passage cross-sectional area of the suction passage 18*f* gradually decreases toward the refrigerant flow downstream direction. In this way, a flow velocity of the suction refrigerant that flows through the suction passage 18*f* gradually increases, and energy loss (i.e., mixing loss) at a time that the suction refrigerant and the injection refrigerant are mixed in the mixing portion 18*e* is thereby reduced.

Of an internal space of the body portion 18*b*, the mixing portion 18*e* is formed in a space that is within an area from the refrigerant injection port 18*c* of the nozzle portion 18*a* to an inlet section 18*h* of the diffuser portion 18*g* in a cross section of the nozzle portion 18*a* in an axial direction. Furthermore, an axial distance La of the nozzle portion 18*a* that is from the refrigerant injection port 18*c* in the mixing portion 18*e* to the inlet section 18*h* is determined such that a flow velocity of the refrigerant flowing into the inlet section 18*h* becomes lower than or equal to the two-phase sound velocity $\alpha h$.

More specifically, in a cross section of the nozzle portion 18*a* that is perpendicular to an axial direction thereof and that includes the refrigerant injection port 18*c*, a circle has a total value of a circular opening cross-sectional area of the refrigerant injection port 18*c* and an arcuate refrigerant passage cross-sectional area of the suction passage 18*f* as an area thereof. When a corresponding diameter of such a circle is set as $\varphi Da$, the distance La is determined to satisfy the following formula F4.

$$La/\varphi Da \leq 1 \quad \text{(F4)}$$

In this embodiment, more specifically, the distance La is determined to satisfy $La/\varphi Da=1$ (e.g., each of the corresponding diameter $\varphi Da$ and the distance La is 8 mm). However, for example, the corresponding diameter $\varphi Da$ and the distance La may be set at 9 mm and 7 mm, respectively.

Furthermore, the mixing portion 18*e* of this embodiment has a shape to reduce the refrigerant passage cross-sectional area toward the downstream side in a refrigerant flow direction. More specifically, the mixing portion 18*e* has a shape defined by a combination of (i) a truncated cone shape in which the refrigerant passage cross-sectional area gradually decreases toward the downstream side in the refrigerant flow direction and (ii) a columnar shape in which the refrigerant passage cross-sectional area is fixed. Moreover, the mixing portion 18*e* is formed in a shape in which the refrigerant passage cross-sectional area of the inlet section 18*h* of the diffuser portion 18*g* is smaller than the refrigerant passage cross-sectional area of the refrigerant injection port 18*c*.

Figure 2:
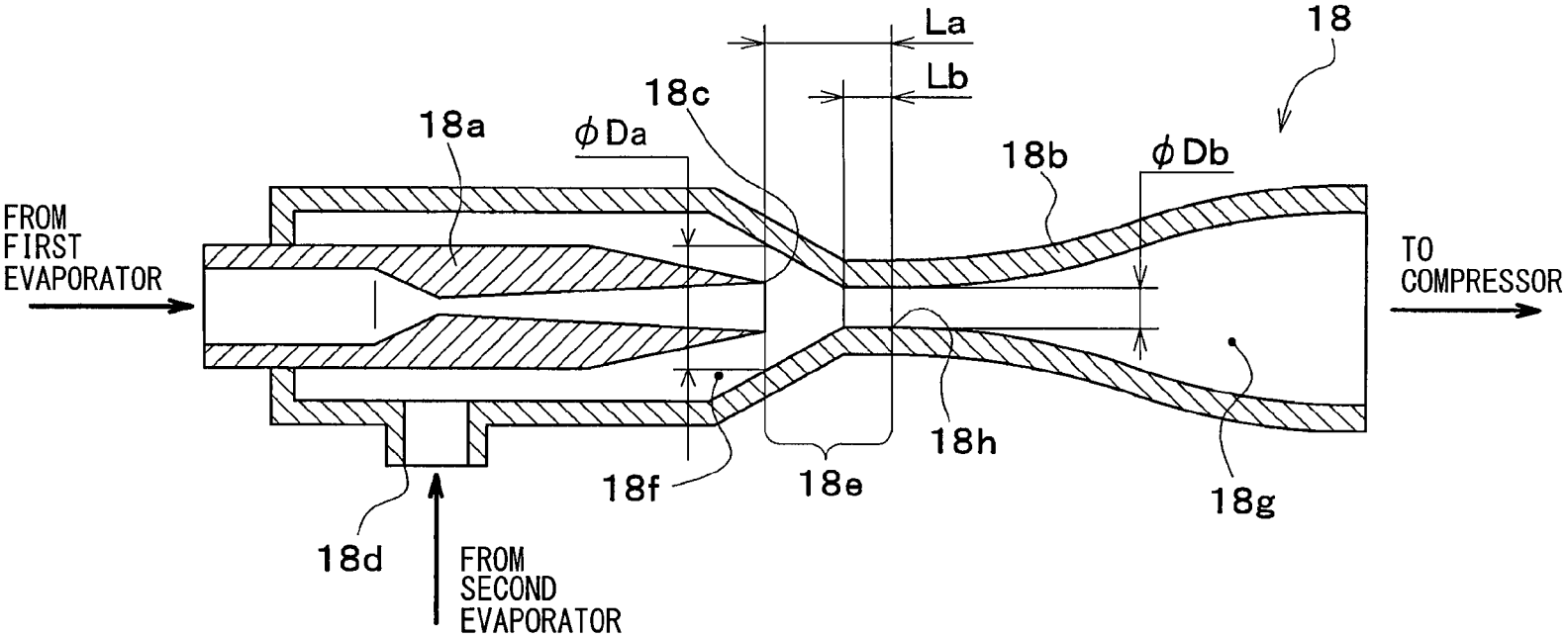
FIG. 2 is an axial cross-sectional view illustrating an ejector of the first embodiment.

In addition, as shown in FIG. 2, when an axial length of the nozzle portion 18*a* in a columnar-shaped portion of the mixing portion 18*e* is set as Lb and a diameter of the columnar-shaped portion (corresponds to a diameter of the inlet section 18*h* of the diffuser portion 18*g*) is set as $\varphi Db$, the distance Lb is determined to satisfy the following formula F5.

$$Lb/\varphi Db \leq 1 \quad \text{(F5)}$$

In this embodiment, more specifically, the distance Lb is determined to satisfy $Lb/\varphi Db=1$ (e.g., each of the diameter φDb and the distance Lb is 7 mm). However, for example, the diameter φDb and the distance Lb may be set at 7 mm and 6 mm, respectively.

The diffuser portion 18*g* is arranged to continue from an outlet of the mixing portion 18*e* and is formed such that the refrigerant passage cross-sectional area gradually increases toward the downstream side in the refrigerant flow direction. Accordingly, the diffuser portion 18*g* fulfills a function of converting velocity energy of the mixed refrigerant, after flowing out of the mixing portion 18*e*, to pressure energy, that is, a function of increasing the pressure of the mixed refrigerant by lowering the flow velocity of the mixed refrigerant.

More specifically, as shown in FIG. 2, a wall surface shape of an inner circumferential wall surface of the body portion 18*b* that forms the diffuser portion 18*g* of this embodiment is formed by combining plural curves. A degree of expansion of the refrigerant passage cross-sectional area in the diffuser portion 18*g* gradually increases toward the refrigerant flow downstream direction, and is then reduced again. In this way, the pressure of the refrigerant can be increased in the isentropic manner.

A suction port of the compressor 11 is connected to a refrigerant outlet side of the diffuser portion 18*g* of the ejector 18.

Next, an electric control unit of this embodiment will be described. The control device, which is not depicted, is constructed of a well-known microcomputer that includes a CPU, a ROM, a RAM, and the like and a peripheral circuit thereof. The control device performs various types of computations and processes on the basis of a control program stored in the ROM thereof and controls operation of various types of control target equipment 11, 12*a*, 15*a*, 17*a*, and the like connected to an output side.

In addition, a sensor group of an inside air temperature sensor, an outside air temperature sensor, a solar radiation sensor, a first evaporator temperature sensor, a second evaporator temperature sensor, an outlet side temperature sensor, an outlet side pressure sensor, a box inside temperature sensor and the like is connected to the control device, and detection values of the sensor group are input thereto. The inside air temperature sensor detects a vehicle interior temperature. The outside air temperature sensor detects an outside air temperature. The solar radiation sensor detects an amount of solar radiation in the vehicle interior. The first evaporator temperature sensor detects a blow-out air temperature of the first evaporator 15 (i.e., an evaporator temperature). The second evaporator temperature sensor detects a blow-out air temperature of the second evaporator 17 (i.e., the evaporator temperature). The outlet side temperature sensor detects a temperature of the outlet side refrigerant of the radiator 12. The outlet side pressure sensor detects pressure of the outlet side refrigerant of the radiator 12. The box inside temperature sensor detects a box temperature of the cool box.

Furthermore, an operation panel that is not depicted and is arranged near a dashboard panel at the forefront on the inside of the vehicle cabin is connected to an input side of the control device, and operation signals from various operation switches provided on the operation panel are input to the control device. As the various operation switches provided in the operation panel, an air-conditioner operation switch for requesting air conditioning of the inside of the vehicle cabin, a vehicle interior temperature setting switch for setting the vehicle interior temperature, and the like are provided.

In the control device of this embodiment, the control units for controlling operation of various types of control target equipment that are connected to the output side thereof are integrally configured. In the control device, a configuration (i.e., hardware and software) for controlling the operation of each type of the control target equipment constitutes the control unit of each type of the control target equipment. For example, in this embodiment, a configuration (i.e., hardware and software) for controlling the operation of the compressor 11 constitutes a discharging ability control unit.

Next, operation of this embodiment in the above configuration will be described by using the Mollier diagram in FIG. 3. First, when the operation switch on the operation panel is turned (ON), the control device operates the electric motor of the compressor 11, the cooling fan 12*a*, the first blower fan 15*a*, the second blower fan 17*a*, and the like. Accordingly, the compressor 11 draws, compresses, and discharges the refrigerant.

Figure 3:
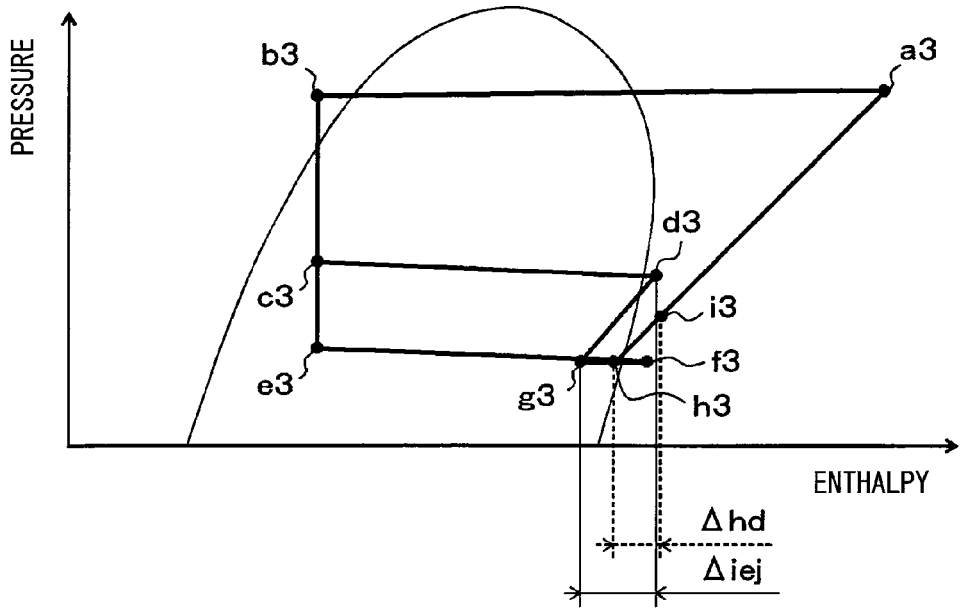
FIG. 3 is a Mollier diagram showing a state of a refrigerant at a time that the ejector-type refrigeration cycle of the first embodiment is operated.

The gas-phase refrigerant that has been discharged from the compressor 11 and is in a high-temperature high-pressure state (point a3 in FIG. 3) flows into the radiator 12, exchanges heat with the air (i.e., the outside air) that has been blown from the cooling fan 12*a*, radiates heat, and is condensed (the point a3→a point b3 in FIG. 3).

The refrigerant flowing out of the radiator 12 flows into the high-stage-side throttling device 13, and the pressure thereof is reduced in the isentropic manner (the point b3→a point c3 in FIG. 3). At this time, an opening degree of the high-stage-side throttling device 13 is adjusted such that the degree of superheat of the outlet side refrigerant of the first evaporator 15 (point d3 in FIG. 3) falls within a predetermined specified range.

The flow of the refrigerant, the pressure of which has been reduced in the high-stage-side throttling device 13, is branched in the branch part 14. One of the refrigerants that have been branched in the branch part 14 flows into the first evaporator 15, absorbs heat from the vehicle cabin inside air that has been blown by the first blower fan 15*a*, and is evaporated (the point c3→the point d3 in FIG. 3). In this way, the vehicle cabin inside air is cooled.

The other of the refrigerants that have been branched in the branch part 14 flows into the low-stage-side throttling device 16, and the pressure thereof is further reduced in the isentropic manner (the point c3→a point e3 in FIG. 3). The refrigerant that has been depressurized in the low-stage-side throttling device 16, flows into the second evaporator 17, absorbs heat from the box inside air that has been circulated and blown by the second blower fan 17*a*, and is evaporated (the point e3→a point f3 in FIG. 3). In this way, the box inside air is cooled.

In addition, the gas-phase refrigerant flowing out of the first evaporator 15 and having the degree of superheat flows into the nozzle portion 18*a* of the ejector 18, the pressure thereof is reduced in the isentropic manner, and the refrigerant is injected as the injection refrigerant (the point d3→a point g3 in FIG. 3). Then, by the suction action of the injection refrigerant, the refrigerant flowing out of the second evaporator 17 is suctioned as the suction refrigerant into the refrigerant suction port 18*d* of the ejector 18.

The injection refrigerant and the suction refrigerant are mixed in the mixing portion 18*e* of the ejector 18 and flow into the diffuser portion 18*g* (the point g3→a point h3, the point f3→the point h3 in FIG. 3).

In the diffuser portion 18*g*, the velocity energy of the refrigerant is converted to the pressure energy due to the increase in the refrigerant passage cross-sectional area. Accordingly, the pressure of the mixed refrigerant of the injection refrigerant and the suction refrigerant is increased (the point h3→a point i3 in FIG. 3). The refrigerant flowing out of the diffuser portion 18*g* is suctioned into the compressor 11 and is compressed again (the point i3→the point a3 in FIG. 3).

As it has been described so far, the ejector-type refrigeration cycle 10 of this embodiment is capable of cooling the vehicle interior air, which is blown into the vehicle cabin, and the box inside air, which is circulated and blown into the cool box. At this time, the refrigerant evaporating pressure (i.e., the refrigerant evaporating temperature) of the second evaporator 17 is lower than the refrigerant evaporating pressure (i.e., the refrigerant evaporating temperature) of the first evaporator 15. Thus, the vehicle interior and the inside of the cool box can be cooled in different temperature ranges.

Furthermore, in the ejector-type refrigeration cycle 10, the refrigerant, the pressure of which has been increased in the diffuser portion 18*g* of the ejector 18, is suctioned into the compressor 11. Thus, the coefficient of performance (COP) of the cycle can be improved by reducing the consumed power by the compressor 11.

Here, as in the ejector-type refrigeration cycle 10 of this embodiment, in the case where the gas-phase refrigerant flowing out of the first evaporator 15 and having the degree of superheat flows into the nozzle portion 18*a* of the ejector 18, the quality x of the mixed refrigerant in the mixing portion 18*e* also tends to have a relatively high value (e.g., the quality x is higher than or equal to 0.8).

Figure 20:
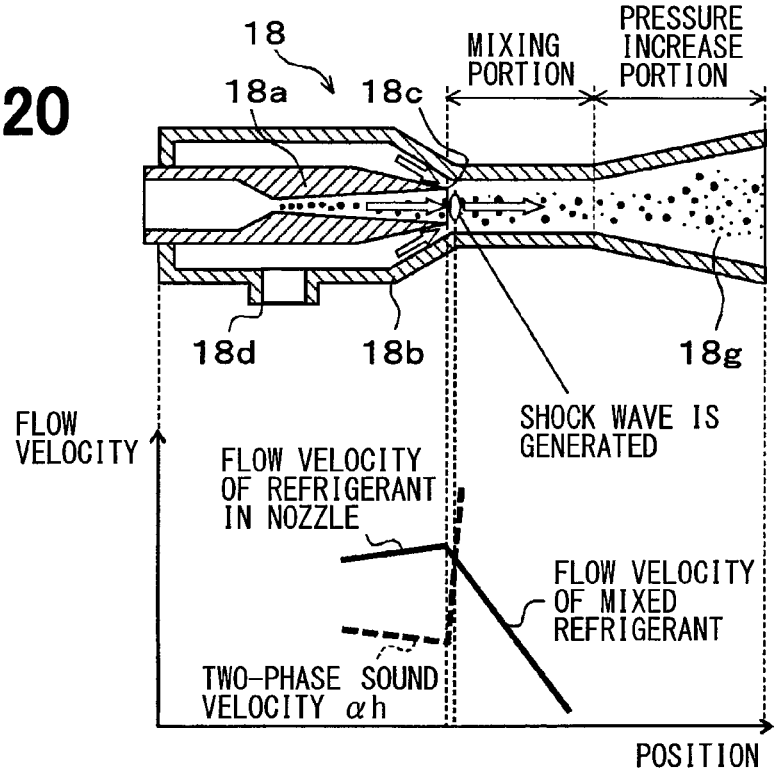
FIG. 20 is an explanatory diagram explaining a position where a shock wave is generated in an ejector during an operation of a general ejector-type refrigeration cycle.

Just as described, when the mixed refrigerant becomes the gas-liquid two-phase refrigerant with the relatively high quality x, the refrigerant pressure increasing performance in the diffuser portion 18*g* becomes unstable as described by using FIG. 20, FIG. 21.

On the contrary, according to the ejector 18 of this embodiment, the distance La that is a distance from the refrigerant injection port 18*c* of the nozzle portion 18*a* to the inlet section 18*h* of the diffuser portion 18*g* in the mixing portion 18*e* in the axial direction of the nozzle portion 18*a* is determined such that the flow velocity of the refrigerant flowing into the inlet section 18*h* becomes lower than or equal to the two-phase sound velocity αh. Accordingly, the shock wave, which is generated at the time that the mixed refrigerant is shifted from the supersonic velocity state to the subsonic velocity state, can be generated in the mixing portion 18*e*.

Thus, the generation of the shock wave in the diffuser portion 18*g* can be restricted, and the flow velocity of the mixed refrigerant flowing through the diffuser portion 18*g* can be restricted from being unstable due to an action of the shock wave. As a result, even the ejector 18, which makes the refrigerant flowing out of the first evaporator 15 flow into the nozzle portion 18*a*, can stabilize the refrigerant pressure increasing performance in the diffuser portion 18*g*. Thus, the deterioration of the refrigerant pressure increasing performance of the ejector 18 can be restricted.

Furthermore, the distance La is determined to satisfy the above formula F4. Thus, the shock wave, which is generated at the time that the mixed refrigerant is shifted from the supersonic velocity state to the subsonic velocity state, can be generated in the mixing portion 18*e*. In addition, an unnecessary increase in the axial length of the ejector 18 can be restricted.

In the ejector 18 of this embodiment, the mixing portion 18*e* has a shape in which the refrigerant passage cross-sectional area gradually decreases toward the downstream side in the refrigerant flow direction. Furthermore, the refrigerant passage cross-sectional area of the inlet section 18*h* of the diffuser portion 18*g* is set smaller than the refrigerant passage cross-sectional area of the refrigerant injection port 18*c* of the nozzle portion 18*a*.

Accordingly, in the mixing portion 18*e* of this embodiment, the flow velocity of the mixed refrigerant is effectively reduced, and the flow velocity of the mixed refrigerant becomes lower than or equal to the two-phase sound velocity αh before the mixed refrigerant reaches the inlet section 18*h* of the diffuser portion 18*g*.

Moreover, according to the examination by the inventor of this disclosure, it has been apparent that the flow velocity of the mixed refrigerant can effectively decrease (i) by setting the shape of the mixing portion 18*e* to be a shape in which the truncated cone shape, in which the refrigerant passage cross-sectional area gradually decreases toward the downstream side in the refrigerant flow direction, and the columnar shape, in which the refrigerant passage cross-sectional area is fixed, are combined, and (ii) by determining the distance Lb in a manner to satisfy the above formula F5.

Figure 4:
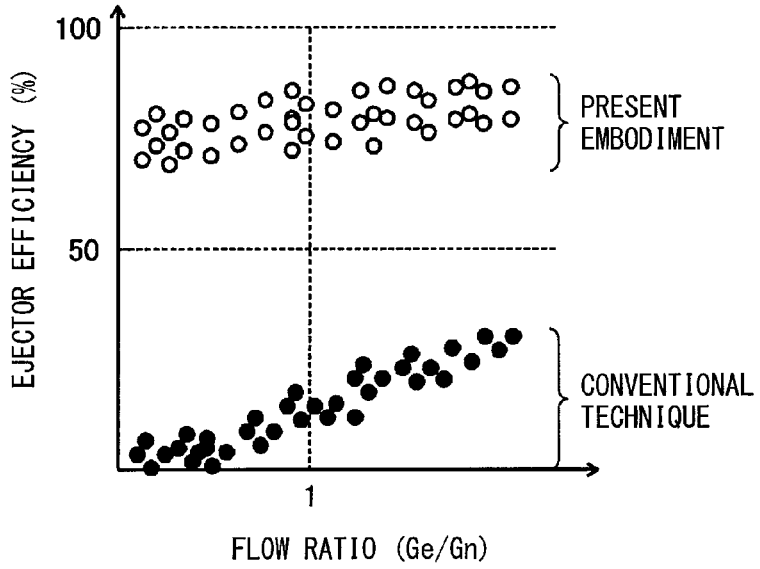
FIG. 4 is a graph explaining ejector efficiency of the ejector of the first embodiment.

Thus, according to the ejector 18 of this embodiment, as shown in FIG. 4, energy conversion efficiency (i.e., ejector efficiency ηej) can significantly be improved in comparison with the background art. As a result, in the ejector-type refrigeration cycle 10 of this embodiment, an effect in improving the COP that is achieved by including the ejector 18 can sufficiently be obtained.

The ejector efficiency ηej is defined by the following formula F6.

$$\eta ej=\{\Delta hd\times(Gn+Ge)\}/(\Delta iej\times Gn) \quad \text{(F6)}$$

Here, Gn is an injection refrigerant flow rate that is injected from the nozzle portion 18*a* of the ejector 18 and is also a flow rate of the refrigerant that flows through the first evaporator 15. In addition, Ge is a suction refrigerant flow rate that is suctioned from the refrigerant suction port 18*d* of the ejector 18, and is also a flow rate of the refrigerant that flows through the second evaporator 17.

As shown in FIG. 3, Δhd is an increased amount of the enthalpy at a time that the pressure of the refrigerant is increased in the isentropic manner in the diffuser portion 18*g* of the ejector 18. As shown in FIG. 3, Δiej is a reduced amount of the enthalpy at a time that the pressure of the refrigerant is reduced in the isentropic manner in the nozzle portion 18*a* of the ejector 18.

Second Embodiment

Figure 5:
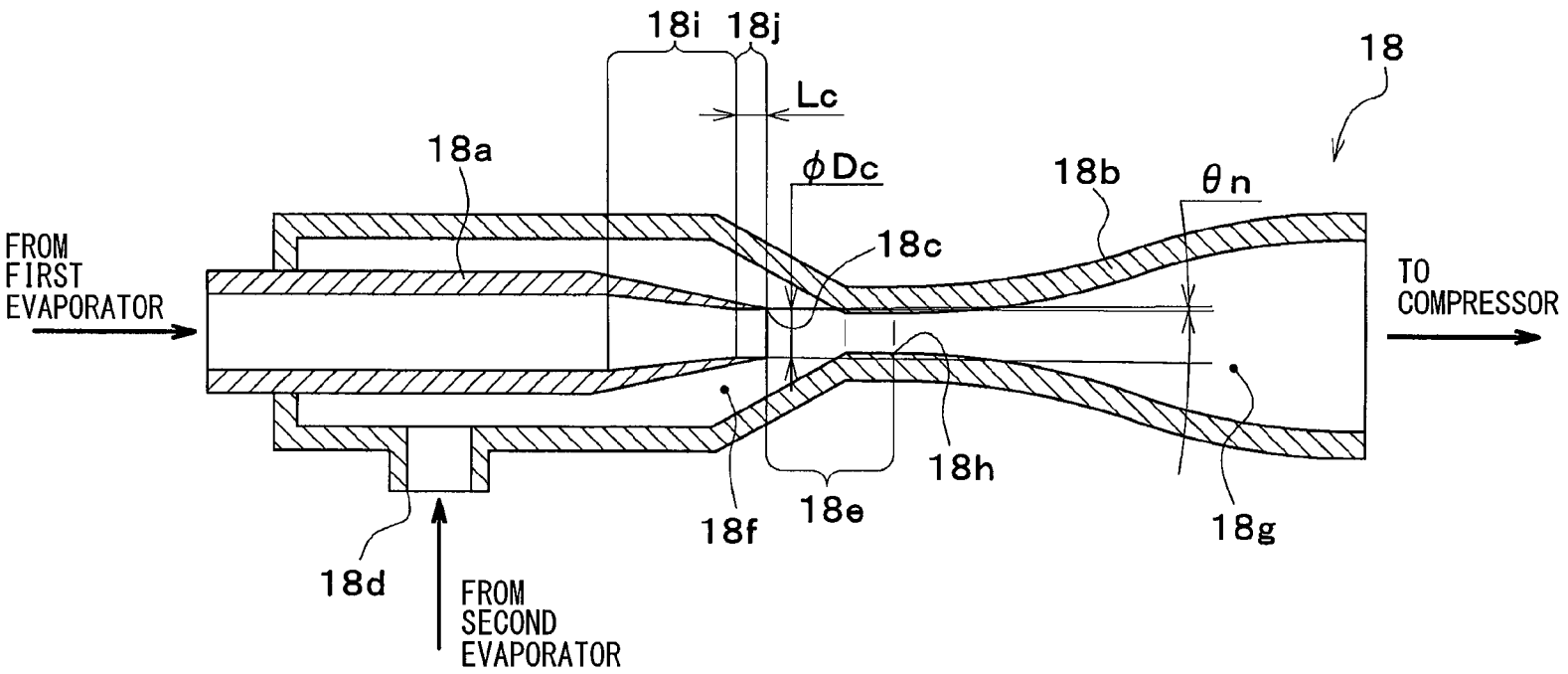
FIG. 5 is an axial cross-sectional view illustrating an ejector of a second embodiment.

In this embodiment, a description will be made on an example in which a configuration of an ejector 18 is changed as shown in FIG. 5 from that in the first embodiment. In FIG. 5 and other drawings, which will be described below, the same or equivalent portions to those in the first embodiment are denoted by the same reference signs.

More specifically, in the ejector 18 of this embodiment, a tapered section 18*i*, in which a refrigerant passage cross-sectional area gradually reduces toward a refrigerant injection port 18*c*, is formed as a refrigerant passage that is formed in a nozzle portion 18*a*. That is, the nozzle portion 18*a* of this embodiment is a so-called tapered nozzle. Furthermore, an injecting section 18*j* is formed on the lowermost downstream side of the refrigerant passage that is formed in the nozzle portion 18*a* of this embodiment.

The injecting section 18*j* is a space that guides the refrigerant from a downstream most portion of the tapered section 18*i* toward the refrigerant injection port 18*c*. Accordingly, a spray shape or an expanding direction of an injection refrigerant that is injected from the refrigerant injection port 18*c* can be changed in accordance with an angle (i.e., an expanding angle) θn of the injecting section 18*j* in an axial cross section of the nozzle portion 18*a*. That is, the injecting section 18*j* can also be expressed as a space that regulates an injection direction of the refrigerant injected from the refrigerant injection port 18*c*.

The injecting section 18*j* is formed such that an inner diameter thereof is fixed or gradually increases toward a downstream side in the refrigerant flow direction. In this embodiment, the angle θn of the injecting section 18*j* in the axial cross section of the nozzle portion 18*a* is set at 0°. That is, the injecting section 18*j* of this embodiment is formed by a columnar space that extends in an axial direction of the nozzle portion 18*a* and has a fixed refrigerant passage cross sectional area. In FIG. 5, in order to clarify the angle θn, the angle θn is illustrated as a slight value (about 1°).

In addition, as shown in FIG. 5, when an axial length of the injecting section 18*j* that is formed in the refrigerant passage provided in the nozzle portion 18*a* is referred to as Lc, and when a corresponding diameter of an opening area of the refrigerant injection port 18*c* is referred to as φDc, the distance Lc is determined to satisfy the following formula F7.

$$Lc/\varphi Dc \leq 1 \quad \text{(F7)}$$

In this embodiment, more specifically, the distance Lc is determined to satisfy Lc/φDc=0.67. However, Lc may be determined to satisfy Lc/φDc=1.

In the nozzle portion 18*a* of this embodiment, the refrigerant passage that is formed therein is formed as described above. In this way, the refrigerant that is injected from the refrigerant injection port 18*c* to a mixing portion 18*e* is expanded freely.

Configurations and operation of the rest of the ejector 18 and an ejector-type refrigeration cycle 10 are similar to those of the first embodiment. Thus, when the ejector-type refrigeration cycle 10 of this embodiment is operated, similar to the first embodiment, vehicle interior air that is blown into a vehicle interior and box inside air that is circulated and blown into a cool box can be cooled.

However, as in the ejector-type refrigeration cycle 10 of this embodiment, in the case where a gas-phase refrigerant flowing out of a first evaporator 15 and having a degree of superheat flows into the nozzle portion 18*a* of the ejector 18, a flow velocity of the injection refrigerant that is immediately after being injected from the refrigerant injection port 18*c* tends to be high. Furthermore, there is a case where the refrigerant flowing through the refrigerant passage that is formed in the nozzle portion 18*a* becomes a gas-liquid two-phase refrigerant with a high gas-liquid density ratio.

When such a gas-liquid two-phase refrigerant with the high gas-liquid density ratio flows through the refrigerant passage formed in the nozzle portion 18*a* at a high velocity, wall surface friction between the refrigerant and the refrigerant passage is significantly increased and leads to loss of kinetic energy of the refrigerant. Accordingly, refrigerant pressure increasing performance in a diffuser portion 18*g* deteriorates.

On the contrary, according to the ejector 18 of this embodiment, the injecting section 18*j* is provided in the nozzle portion 18*a* that is constituted as the tapered nozzle, and the mixed refrigerant that is injected from the refrigerant injection port 18*c* to the mixing portion 18*e* is expanded freely. Thus, the injection refrigerant can be accelerated at the mixing portion 18*e* without providing a flare section as in a de Laval nozzle. That is, the refrigerant can be accelerated without generating the wall surface friction between the refrigerant and the refrigerant passage that is generated when the refrigerant is accelerated to have a supersonic velocity in the flare section of the de Laval nozzle.

Therefore, loss of kinetic energy of the refrigerant flowing through the refrigerant passage can be restricted by reducing the wall surface friction between the refrigerant and the refrigerant passage, and the flow velocity of the injection refrigerant can thus be restricted from being reduced. As a result, the ejector 18, which makes the refrigerant flowing out of the first evaporator 15 flow into the nozzle portion 18*a*, can restrict deterioration of the refrigerant pressure increasing performance of the ejector 18 by reducing the loss of the energy of the refrigerant in the nozzle portion 18*a*.

In addition, according to the ejector 18 of this embodiment, similar to the first embodiment, the refrigerant pressure increasing performance in the diffuser portion 18*g* can be stabilized, and ejector efficiency ηej in the ejector 18 can be improved. Thus, in the ejector-type refrigeration cycle 10 of this embodiment, an effect in improving a COP that is achieved by including the ejector 18 can sufficiently be obtained.

In this embodiment, the description has been made on the example in which the angle θn of the injecting section 18*j* in the axial cross section of the nozzle portion 18*a* is set at 0°. However, the angle θn can be set larger than 0° as long as the refrigerant that is injected from the refrigerant injection port 18*c* can be expanded freely. That is, the injecting section 18*j* may be formed by a truncated cone shaped space of which inner diameter gradually increases toward a downstream direction of the refrigerant flow.

Third Embodiment

Figure 6:
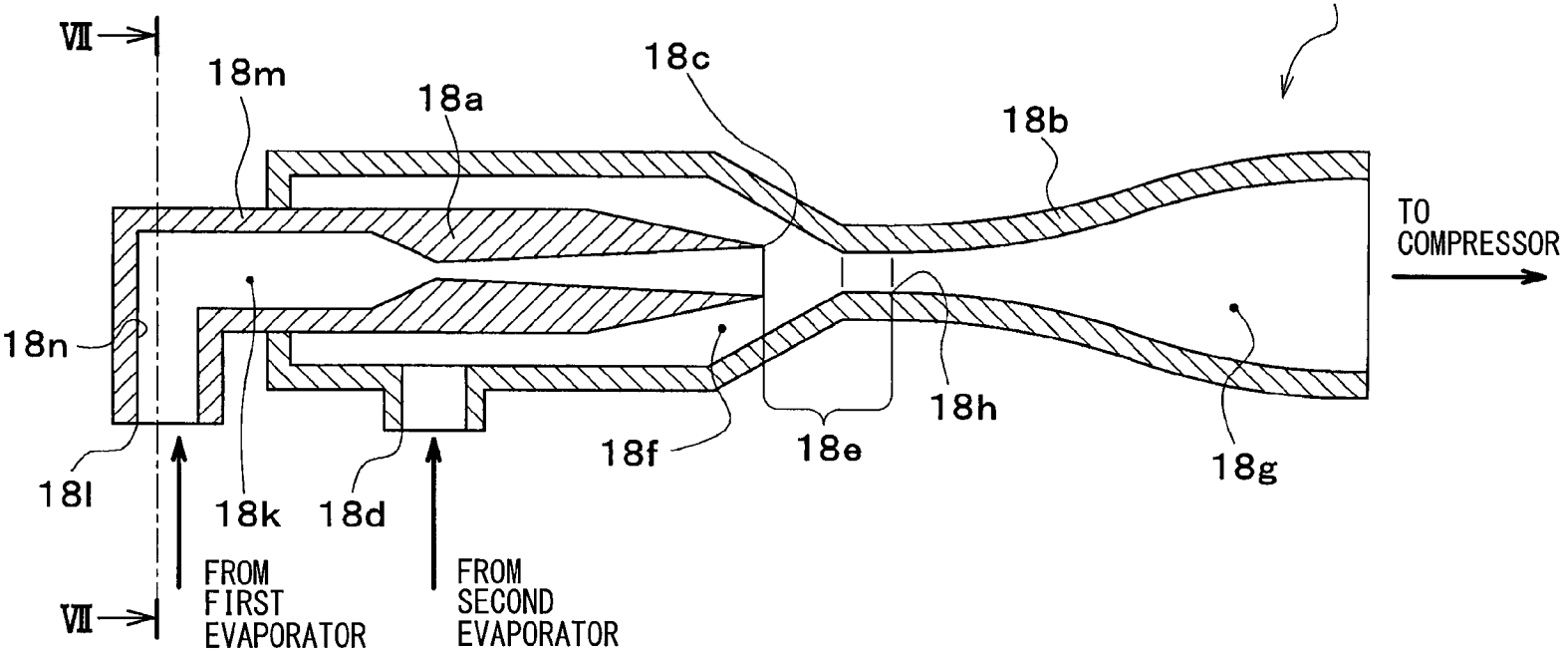
FIG. 6 is an axial cross-sectional view illustrating an ejector of a third embodiment.
Figure 7:
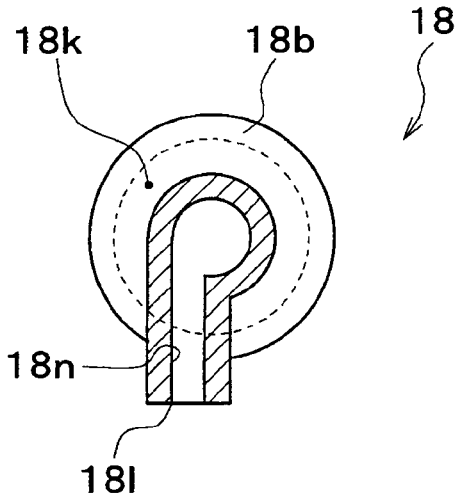
FIG. 7 is a cross-sectional view taken along a line VII-VII shown in FIG. 6.

In this embodiment, a description will be made on an example in which a configuration of an ejector 18 is changed from that in the first embodiment as shown in FIG. 6, FIG. 7. More specifically, in the ejector 18 of this embodiment, a swirl space 18*k*, in which a refrigerant flowing thereinto from a refrigerant inlet port 18*l* swirls around an axis of a nozzle portion 18*a*, is provided on an upstream side, in the refrigerant flow direction, of a throat section (i.e., a minimum passage cross-sectional area section) of a refrigerant passage that is formed in the nozzle portion 18*a*.

In detail, the swirl space 18*k* is formed on the inside of a cylindrical section 18*m* that is provided on the upstream side in the nozzle portion 18*a* in the refrigerant flow direction. The cylindrical section 18*m* constitutes a swirl space forming member described in the claims. Thus, in this embodiment, the swirl space forming member and the nozzle portion are integrally configured.

The swirl space 18*k* is formed in a rotational body shape, and a center axis thereof extends in a coaxial manner with the nozzle portion 18*a*. The rotational body shape is a stereoscopic shape that is formed when a plane figure is rotated about a straight line (i.e., a center axis) on the same plane. More specifically, the swirl space 18*k* of this embodiment is formed in a substantially columnar shape.

Furthermore, a refrigerant inflow passage 18*n* that connects between the refrigerant inlet port 18*l* and the swirl space 18*k* extends in a tangential direction of an inner wall surface of the swirl space 18*k* as shown in FIG. 7 when seen in a direction of the center axis of the swirl space 18*k*. Accordingly, the refrigerant flowing into the swirl space 18*k* from the refrigerant inlet port 18*l* flows along the inner wall surface of the swirl space 18*k* and swirls in the swirl space 18*k*.

Here, a centrifugal force acts on the refrigerant that swirls in the swirl space 18*k*. Thus, in the swirl space 18*k*, refrigerant pressure on the center axis side becomes lower than the refrigerant pressure on an outer circumferential side. For this reason, in this embodiment, the refrigerant pressure on the center axis side in the swirl space 18*k* is reduced during a normal operation such that the refrigerant on the center axis side in the swirl space 18*k* is on a gas-liquid two-phase side from a saturated gas line, that is, such that the refrigerant on the center axis side in the swirl space 18*k* starts being condensed.

Such adjustment of the refrigerant pressure on the center axis side in the swirl space 18*k* can be realized by adjusting a swirling flow velocity of the refrigerant that swirls in the swirl space 18*k*. Furthermore, adjustment of the swirling flow velocity can be performed, for example, by adjusting a ratio of a flow channel cross-sectional area between a passage cross-sectional area of the refrigerant inflow passage 18*n* and a cross-sectional area of the swirl space 18*k* that is perpendicular to the axial direction, or by adjusting an opening degree of a high-stage-side throttling device 13 that is arranged on an upstream side of the nozzle portion 18*a*.

Configurations and operation of the rest of the ejector 18 and an ejector-type refrigeration cycle 10 are similar to those of the first embodiment. Thus, when the ejector-type refrigeration cycle 10 of this embodiment is operated, similar to the first embodiment, vehicle interior air that is blown into a vehicle interior and box inside air that is circulated and blown into a cool box can be cooled.

In the case where a gas-phase refrigerant flowing out of a first evaporator 15 and having a degree of superheat flows into the nozzle portion 18*a* of the ejector 18 as in the ejector-type refrigeration cycle 10 of this embodiment, as described above, the refrigerant is condensed and accelerated while pressure thereof is reduced in the refrigerant passage formed in the nozzle portion 18*a* of the ejector 18.

In such an ejector 18, energy loss may occur due to wall surface friction between the refrigerant and the refrigerant passage. Furthermore, when the gas-phase refrigerant that flows through the refrigerant passage formed in the nozzle portion 18*a* is condensed, as indicated by a point d25→a point g25 in FIG. 25, a condensation delay, in which condensation is not immediately started even in a saturated state and the refrigerant is brought into an oversaturated state may occur.

Figure 25:
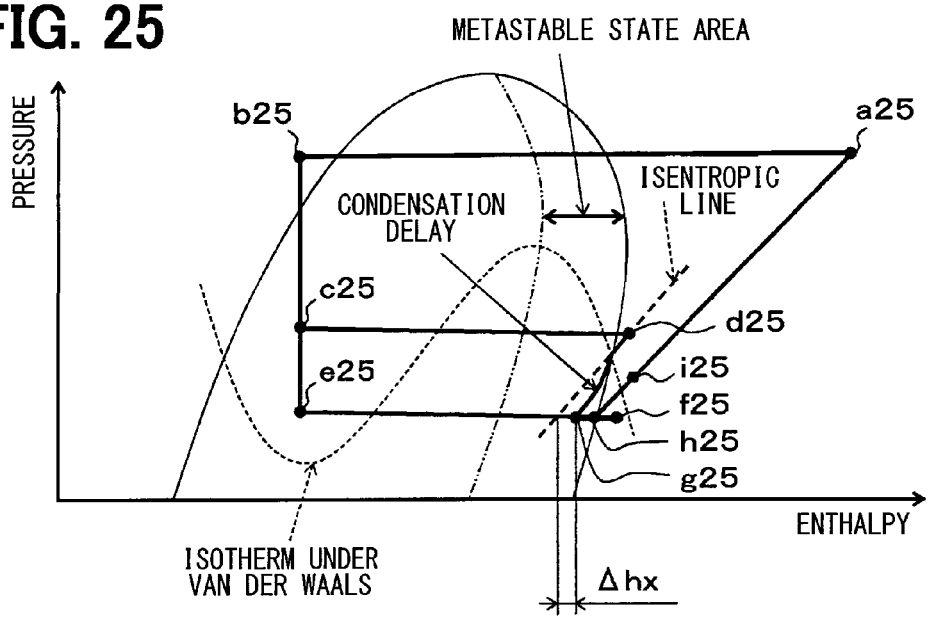
FIG. 25 is a Mollier diagram showing a state of the refrigerant at a time that a condensation delay occurs in the nozzle portion of the ejector.

FIG. 25 is a Mollier diagram that depicts a change in a state of the refrigerant in the case where the condensation delay occurs. The refrigerant in the same state as that in FIG. 3 is denoted by the same reference sign (i.e., alphabet) as that in FIG. 3, and only a suffix (i.e., number) is changed. The same applies to the other Mollier diagrams.

A cause of occurrence of such a condensation delay will be described. When a force between molecules that is a van der Waals force is taken into examination, as shown in the Mollier diagram in FIG. 25, an isotherm of a gas-liquid two-phase refrigerant is drawn as a curve that is deviated from an isopiestic line.

Accordingly, the refrigerant in a region where an enthalpy thereof is slightly reduced from that on the saturated gas line turns into a metastable state in which the refrigerant cannot be condensed unless a temperature thereof is reduced to be lower than the refrigerant on the saturated gas line at the same pressure. Thus, when the gas-phase refrigerant flows into the nozzle portion 18*a*, the condensation delay in which the condensation of the refrigerant in the metastable state is not started until the temperature thereof is reduced to some extent occurs.

When the condensation delay further occurs, the enthalpy of an injection refrigerant is increased (increased amount of the enthalpy corresponds to Δhx in FIG. 25) in comparison with a case where the refrigerant is expanded in an isentropic manner in the nozzle portion 18*a*. The refrigerant releases energy as latent heat when flowing through the refrigerant passage formed in the nozzle portion 18*a*. The increased amount of the enthalpy corresponds to a latent heat release amount. Thus, when the latent heat release amount is increased, a shock wave is generated to the refrigerant that flows through the refrigerant passage formed in the nozzle portion 18*a*.

The shock wave that is generated at a time that the refrigerant releases the latent heat makes the flow velocity of the injection refrigerant unstable. Thus, refrigerant pressure increasing performance in a diffuser portion 18*g* deteriorates.

On the contrary, in the ejector 18 of this embodiment, the refrigerant swirls in the swirl space 18*k*. Accordingly, the condensation of the refrigerant on the center axis side in the swirl space 18*k* is started, and the gas-liquid two-phase refrigerant in which a condensation nucleus is generated can flow into the nozzle portion 18*a*. Accordingly, the occurrence of the condensation delay in the refrigerant in the nozzle portion 18*a* can be restricted.

Figure 8:
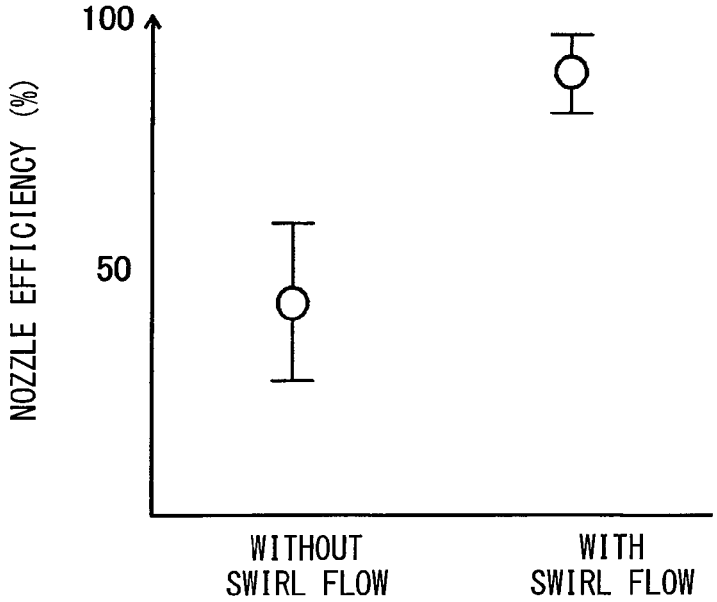
FIG. 8 is a graph explaining nozzle efficiency of the ejector of the third embodiment.

As a result, as shown in FIG. 8, nozzle efficiency ηnoz in the nozzle portion 18*a* can significantly be improved in comparison with the background art. In the ejector 18 that condenses and accelerates the refrigerant while reducing the pressure thereof in the refrigerant passage formed in the nozzle portion 18*a*, the deterioration of the refrigerant pressure increasing performance in the diffuser portion 18*g* can be restricted. The nozzle efficiency ηnoz is energy conversion efficiency at a time that pressure energy of the refrigerant is converted to kinetic energy in the nozzle portion 18*a*.

In addition, according to the ejector 18 of this embodiment, similar to the first embodiment, the refrigerant pressure increasing performance in the diffuser portion 18*g* can be stabilized, and ejector efficiency ηej in the ejector 18 can be improved. Thus, in the ejector-type refrigeration cycle 10 of this embodiment, an effect in improving a COP that is achieved by including the ejector 18 can sufficiently be obtained.

Furthermore, according to the ejector 18 of this embodiment, even in the case where the refrigerant that flows into the swirl space 18*k* is the gas-liquid two-phase refrigerant, boiling of the refrigerant that flows into the throat section (i.e., the minimum passage cross-sectional area section) of the nozzle portion 18*a* can be promoted by reducing the refrigerant pressure on the center axis side in the swirl space 18*k*. Thus, the nozzle efficiency ηnoz can be improved.

Fourth Embodiment

In this embodiment, a description will be made on an example in which a configuration of an ejector-type refrigeration cycle is changed from that in the first embodiment.

Figure 9:
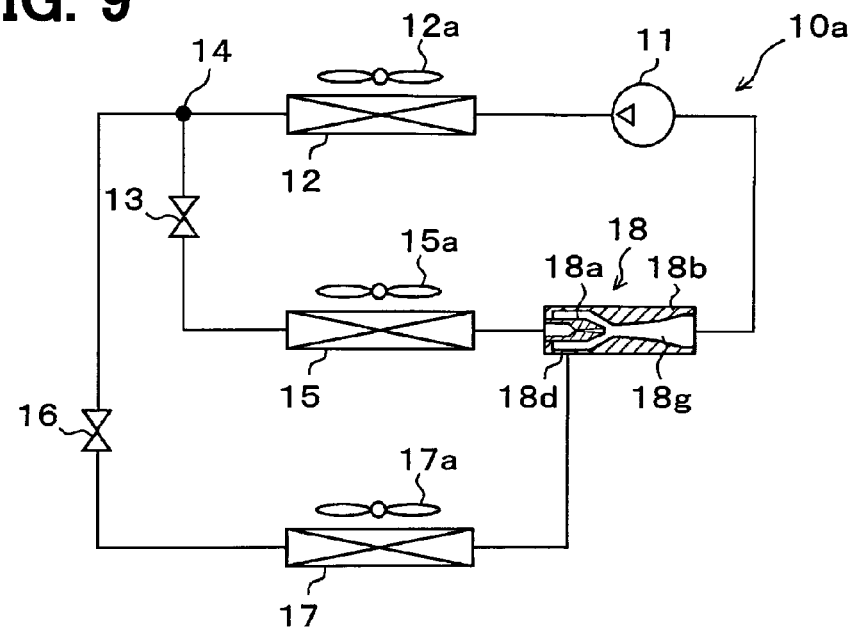
FIG. 9 is an overall configuration diagram illustrating an ejector-type refrigeration cycle of a fourth embodiment.

More specifically, in an ejector-type refrigeration cycle 10*a* of this embodiment, as shown in FIG. 9, a branch part 14 is arranged on an outlet side of a radiator 12. Pressure of one of refrigerants that have been branched in the branch part 14 is reduced in a high-stage-side throttling device 13 until the refrigerant becomes a low-pressure refrigerant, and the refrigerant flows into a refrigerant inlet side of a first evaporator 15. In addition, pressure of the other of the refrigerants that have been branched in the branch part 14 is reduced in a low-stage-side throttling device 16 until the refrigerant becomes the low-pressure refrigerant, and the refrigerant flows into a refrigerant inlet side of a second evaporator 17.

Furthermore, in this embodiment, an opening degree of the low-stage-side throttling device 16 is set smaller than an opening degree of the high-stage-side throttling device 13, and a pressure reduction amount in the low-stage-side throttling device 16 is larger than a pressure reduction amount in the high-stage-side throttling device 13. Accordingly, refrigerant evaporating pressure (i.e., a refrigerant evaporating temperature) in the second evaporator 17 is lower than the refrigerant evaporating pressure (i.e., the refrigerant evaporating temperature) in the first evaporator 15. The rest of the configuration is the same as that in the first embodiment.

Figure 10:
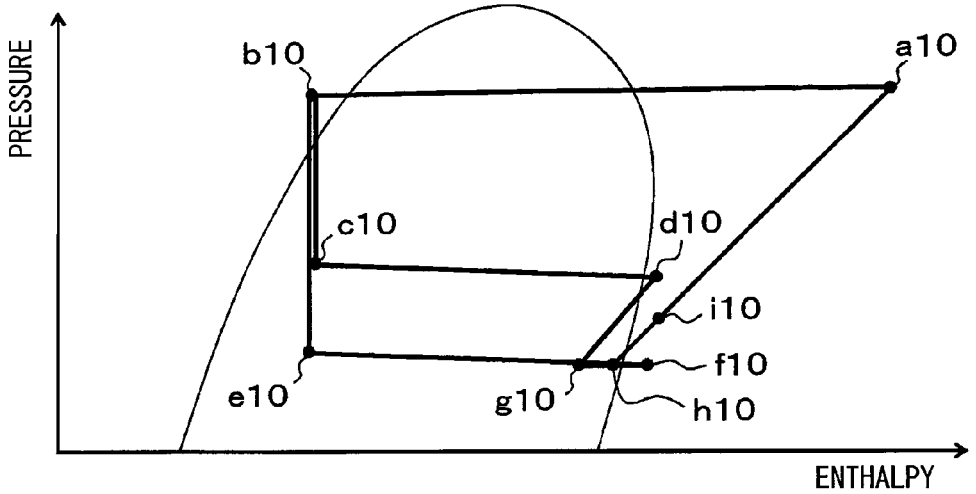
FIG. 10 is a Mollier diagram showing a state of a refrigerant at a time that the ejector-type refrigeration cycle of the fourth embodiment is operated.

Thus, when the ejector-type refrigeration cycle 10*a* of this embodiment is operated, as shown in a Mollier diagram in FIG. 10, similar to the first embodiment, a gas-phase refrigerant that has been discharged from a compressor 11 and is in a high-temperature high-pressure state (point a10 in FIG. 10) radiates heat and is condensed in the radiator 12 (the point a10→a point b10 in FIG. 10).

A flow of the refrigerant flowing out of the radiator 12 is branched in the branch part 14. The pressure of the one of the refrigerants that have been branched in the branch part 14 is reduced in the high-stage-side throttling device 13 (the point b10→a point c10 in FIG. 10), and the refrigerant flows into the first evaporator 15. The pressure of the other of the refrigerants that have been branched in the branch part 14 is reduced in the low-stage-side throttling device 16 (the point b10→a point e10 in FIG. 10), and the refrigerant flows into the second evaporator 17. The operation onward is similar to that in the first embodiment.

Thus, when the ejector-type refrigeration cycle 10*a* of this embodiment is operated, similar to the first embodiment, vehicle cabin inside air that is blown into a vehicle interior and box inside air that is circulated and blown into a cool box can be cooled.

Furthermore, also in the ejector-type refrigeration cycle 10*a* of this embodiment, an ejector 18 exerts similar effects as those in the first embodiment. Thus, an effect in improving a COP by including the ejector 18 can sufficiently be obtained. Moreover, the ejector 18 that is disclosed in any of the second, the third, an eighth, and a ninth embodiments can be adopted in the ejector-type refrigeration cycle 10*a* of this embodiment.

Fifth Embodiment

In this embodiment, a description will be made on an example in which a configuration of an ejector-type refrigeration cycle is changed from that in the first embodiment.

Figure 11:
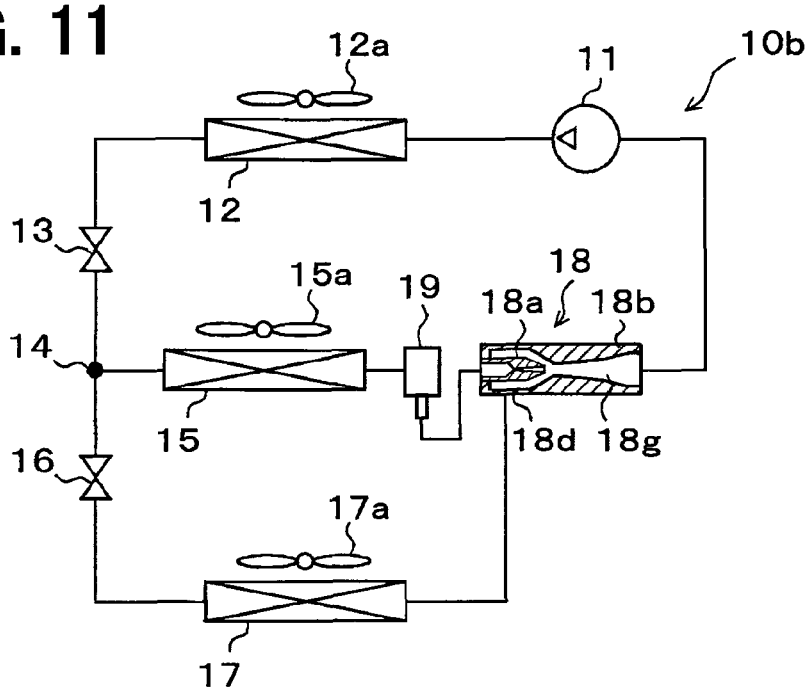
FIG. 11 is an overall configuration diagram illustrating an ejector-type refrigeration cycle of a fifth embodiment.

More specifically, in an ejector-type refrigeration cycle 10*b* of this embodiment, as shown in FIG. 11, a fixed throttle of which opening degree is fixed is adopted as a high-stage-side throttling device 13, and a temperature type expansion valve is adopted as a low-stage-side throttling device 16. Furthermore, a liquid storage tank (i.e., a liquid storage section) 19 that stores a surplus refrigerant in the cycle is arranged between a refrigerant outlet side of a first evaporator 15 and an inlet side of a nozzle portion 18*a* of an ejector 18.

Figure 12:
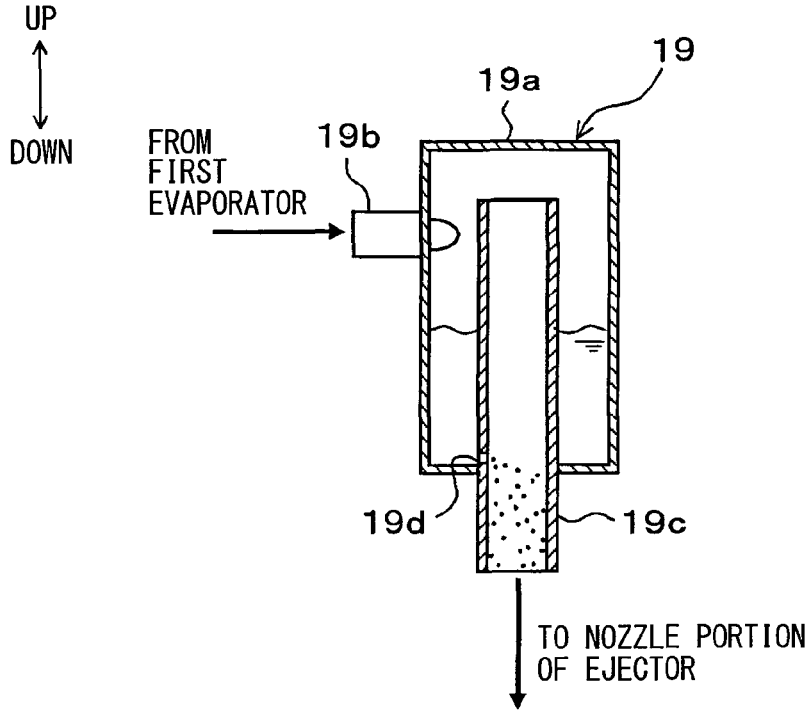
FIG. 12 is a cross-sectional view illustrating a liquid storage tank of the fifth embodiment.

A detailed configuration of the liquid storage tank 19 will be described by using FIG. 12. Each of up and down arrows in FIG. 12 indicates each of up and down directions in a state that the liquid storage tank 19 is mounted in a vehicle.

The liquid storage tank 19 has a main body portion 19*a*, a refrigerant inlet port 19*b*, a refrigerant outlet port 19*c*, and the like. The main body portion 19*a* is formed by a cylindrical member that extends in an up-down direction and both ends of which are closed. The refrigerant inlet port 19*b* makes a refrigerant flowing out of the first evaporator 15 flow into the main body portion 19*a*. The refrigerant outlet port 19*c* makes a gas-liquid two-phase refrigerant flow out from the inside of the main body portion 19*a* to the nozzle portion 18*a* side of the ejector 18.

The refrigerant inlet port 19*b* is connected to a cylindrical side surface of the main body portion 19*a*, and is constructed of a refrigerant piping that extends in a tangential direction of the cylindrical side surface of the main body portion 19*a*. The refrigerant outlet port 19*c* is connected to an axial-lower-side end surface (i.e., a bottom surface) of the main body portion 19*a*, and is constructed of a refrigerant piping that extends across the inside and the outside of the main body portion 19*a* in a coaxial manner with the main body portion 19*a*.

Furthermore, an upper end of the refrigerant outlet port 19*c* extends to an upper side than a connected portion of the refrigerant inlet port 19*b*. Moreover, a liquid-phase refrigerant introducing hole 19*d* that makes a liquid-phase refrigerant stored in the main body portion 19*a* flow into the refrigerant outlet port 19*c* is formed on a lower side of the refrigerant outlet port 19*c*.

Accordingly, in an operating condition in which a flow rate of a circulating refrigerant that circulates through the cycle is reduced and the gas-liquid two-phase refrigerant flows out of the first evaporator 15, the refrigerant flowing into the main body portion 19*a* from the refrigerant inlet port 19*b* flows while being swirling along a cylindrical inner wall surface of the main body portion 19*a*, and the refrigerant are separated into liquid-phase refrigerant and gas-phase refrigerant by an action of a centrifugal force that is generated by a swirl flow.

The separated liquid-phase refrigerant falls to the lower side by an action of gravity and is stored in the main body portion 19*a* as the surplus refrigerant. Meanwhile, the separated gas-phase refrigerant is mixed with the liquid-phase refrigerant flowing into the refrigerant outlet port 19*c* from the liquid-phase refrigerant introducing hole 19*d* when flowing out to the inlet side of the nozzle portion 18*a* via the refrigerant outlet port 19*c*, and flows out as the gas-liquid two-phase refrigerant.

In addition, in an operating condition in which the flow rate of the circulating refrigerant that circulates through the cycle is increased and in which the gas-phase refrigerant flows out of the first evaporator 15, the gas-phase refrigerant from the refrigerant inlet port 19*b* flows out to the inlet side of the nozzle portion 18*a* through the refrigerant outlet port 19*c* without being separated into the liquid and the gas. At this time, the gas-phase refrigerant flowing into the refrigerant outlet port 19*c* is mixed with the liquid-phase refrigerant flowing into the refrigerant outlet port 19*c* from the liquid-phase refrigerant introducing hole 19*d*, and flows out therefrom as the gas-liquid two-phase refrigerant.

That is, the liquid storage tank 19 of this embodiment constitutes a gas-liquid supply section in which the refrigerant flowing out of the first evaporator 15 flows out in a gas-liquid two-phase state to the inlet side of the nozzle portion 18*a*. More specifically, the liquid storage tank 19 mixes the liquid-phase refrigerant stored in the main body portion 19*a* and the refrigerant flowing out of the first evaporator 15 and makes the refrigerant flow out to the inlet side of the nozzle portion 18*a*.

Configurations and operation of the rest of the ejector 18 and the ejector-type refrigeration cycle 10*b* are similar to those of the first embodiment. Thus, when the ejector-type refrigeration cycle 10*b* of this embodiment is operated, similar to the first embodiment, vehicle interior air that is blown into a vehicle interior and box inside air that is circulated and blown into a cool box can be cooled.

In the ejector-type refrigeration cycle that is configured to make the gas-phase refrigerant flow into the nozzle portion 18*a* of the ejector 18, a quality x of a mixed refrigerant in which an injection refrigerant and a suction refrigerant are mixed in a mixing portion 18*e* tends to have a relatively high value (e.g., the quality x is higher than or equal to 0.8).

In such an ejector-type refrigeration cycle, as described by using FIG. 25, a condensation delay occurs, and refrigerant pressure increasing performance in a diffuser portion 18*g* may deteriorate. In addition, as described by using FIG. 20, FIG. 21, the refrigerant pressure increasing performance in the diffuser portion 18*g* may become unstable.

According to the examination of the inventors of the subject application, in the case where the quality x of the mixed refrigerant increases and the mixed refrigerant becomes the gas-liquid two-phase refrigerant of which quality x is higher than or equal to 0.995, the diffuser portion 18*g* of the ejector 18 is incapable of exerting the desired refrigerant pressure increasing performance. Furthermore, a flow rate of the suction refrigerant in the ejector 18 may decrease.

A reason for the above is because a shearing force that the liquid-phase refrigerant in the mixed refrigerant receives from the gas-phase refrigerant is increased in the gas-liquid two-phase refrigerant with the high quality, and thus an average particle diameter of droplets (i.e., particles of the liquid-phase refrigerant) in the mixed refrigerant is reduced.

Figure 22:
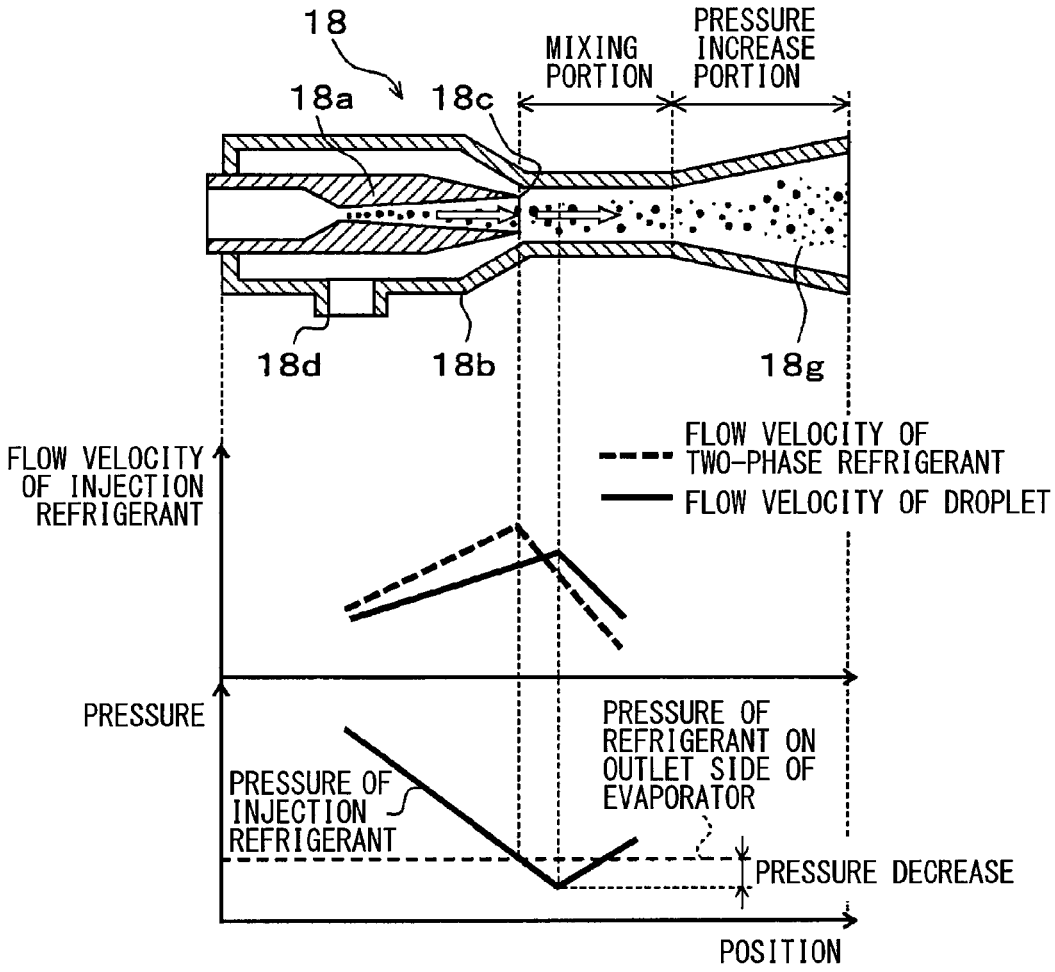
FIG. 22 is an explanatory diagram explaining a pressure change of a mixed refrigerant during the operation of the general ejector-type refrigeration cycle.
Figure 23:
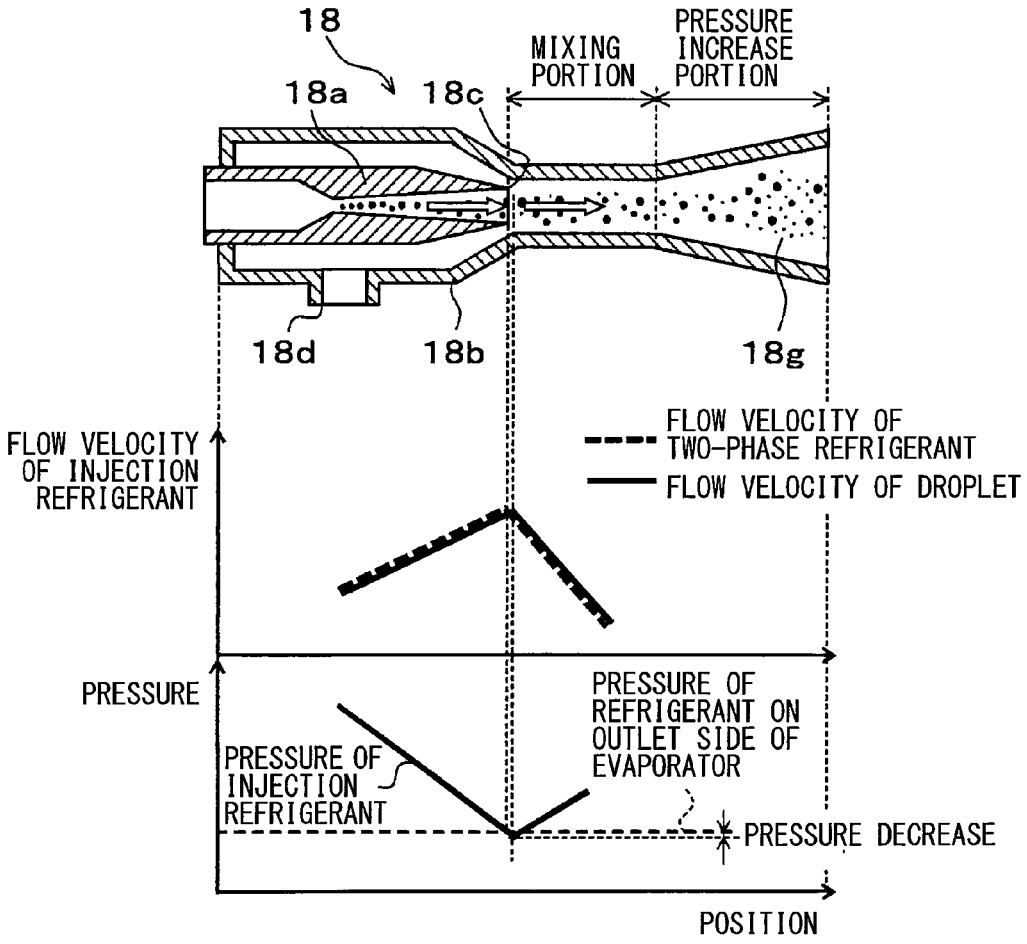
FIG. 23 is an explanatory diagram explaining the pressure change of the mixed refrigerant during the operation in which the quality of the refrigerant flowing into the nozzle portion is relatively high.

A cause of a reduction in a suction refrigerant flow rate in the ejector due to the reduced average particle diameter of the droplets in the mixed refrigerant will be described by using FIG. 22, FIG. 23. In FIG. 22, FIG. 23, similar to FIG. 20, FIG. 21 described above, an axial cross section of a general ejector is schematically depicted.

First, when the gas-liquid two-phase refrigerant of which quality is not high flows into the nozzle portion 18*a* of the ejector 18, the gas-phase refrigerant in the injection refrigerant decelerates while being mixed with the suction refrigerant. Meanwhile, regarding the liquid-phase refrigerant (i.e., the droplets) in the injection refrigerant accelerates by an inertia force at a time that the liquid-phase refrigerant is injected from a refrigerant injection port 18*c* of the nozzle portion 18*a*. The inertia force of the droplet is expressed by an integrated value of a weight of the droplet and a velocity of the droplet in the refrigerant injection port 18*c*.

Since the droplet is accelerated as described above, pressure energy of the mixed refrigerant is converted to velocity energy. As indicated by a solid line in a graph on a lower side in FIG. 22, pressure of the mixed refrigerant can be reduced to be lower than pressure of the refrigerant flowing out of an evaporator connected to a refrigerant suction port 18*d*. Furthermore, the gas-phase refrigerant flowing out of the evaporator can be suctioned due to the pressure reduction of the mixed refrigerant.

By the way, when the gas-liquid two-phase refrigerant with the high quality flows into the nozzle portion 18*a* of the ejector 18, not only a magnitude of resistance that the droplet in the mixed refrigerant receives from the gas-phase refrigerant is increased, but also the average particle diameter of the droplets is reduced and the weight of the droplet is reduced. Thus, the inertia force of the droplet is also reduced.

Accordingly, the velocity of the droplet at a time that the gas-liquid two-phase refrigerant with the high quality flows into the nozzle portion 18*a* is changed to become substantially equivalent to that of the gas-phase refrigerant. Thus, the velocity of the droplet in the mixed refrigerant cannot be increased sufficiently, and, as indicated by a solid line in a graph on a lower side in FIG. 23, the pressure of the mixed refrigerant is less likely to be reduced. As a result, the suction refrigerant flow rate of the ejector 18 is reduced.

Furthermore, in a region where the mixed refrigerant becomes the gas-phase refrigerant and a refrigerant passage cross-sectional area in the mixing portion 18*e* does not change, an expansion wave that is generated at a time that the injection refrigerant is injected from the refrigerant injection port 18*c* collides with a compression wave that is generated when the injection refrigerant and the suction refrigerant merge. In this way, multiple periodical shock waves called barrel shock waves as shown in FIG. 24 may be generated in the mixed refrigerant.

Such a barrel shock wave periodically changes the flow velocity of the mixed refrigerant from a supersonic velocity state to a subsonic velocity state, and further from the subsonic velocity state to the supersonic velocity state. Accordingly, the velocity energy of the mixed refrigerant is significantly lost. Thus, the barrel shock wave can be a cause of significantly reducing the suction refrigerant flow rate of the ejector 18 or a cause of generating large operating sound in the ejector 18.

Figure 24:
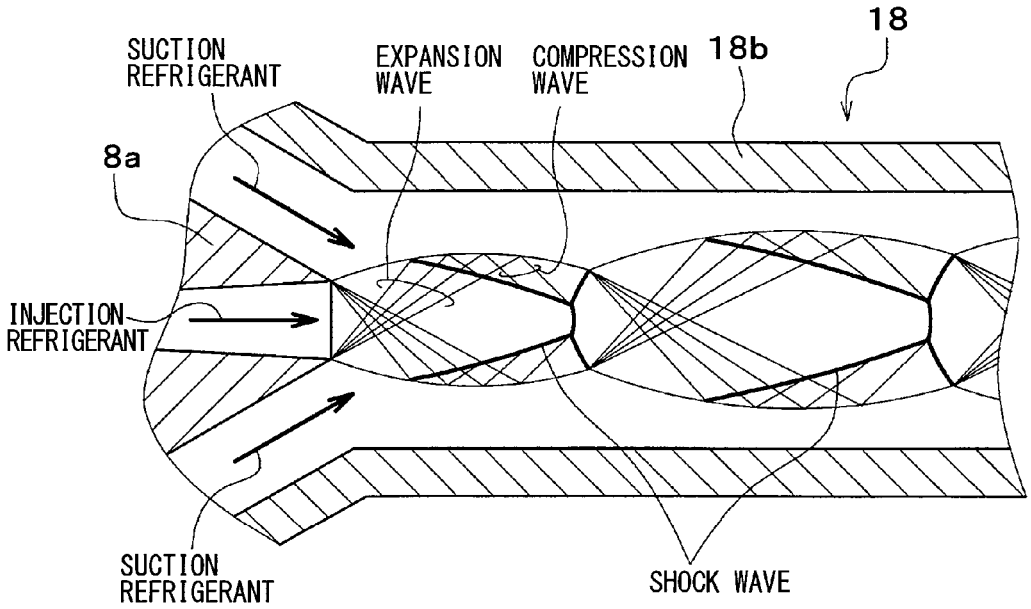
FIG. 24 is an explanatory diagram explaining a barrel shock wave.

FIG. 24 is an explanatory diagram explaining the barrel shock wave, and is an enlarged schematic cross-sectional view of a periphery of the refrigerant injection port 18*c* of the nozzle portion 18*a* in the ejector 18 of the conventional art.

On the contrary, the ejector-type refrigeration cycle 10*b* of this embodiment includes the liquid storage tank 19 as the gas-liquid supply section. Thus, the gas-liquid two-phase refrigerant can reliably flow into the nozzle portion 18*a* of the ejector 18. Therefore, the occurrence of the condensation delay can reliably be restricted.

Furthermore, the gas-liquid two-phase refrigerant flows into the nozzle portion 18*a*, and the pressure thereof is reduced in an isentropic manner. For this reason, the injected fuel also reliably becomes the gas-liquid two-phase refrigerant. Thus, an increase in the quality x of the mixed refrigerant can be restricted. Therefore, the refrigerant pressure increasing performance in the diffuser portion 18*g* can be restricted from being unstable, and the suction refrigerant flow rate of the ejector 18 can be restricted from being reduced.

In addition to the above, a two-phase sound velocity $\alpha h$ of the mixed refrigerant can be reduced by reducing the quality x of the injected fuel. Accordingly, the shock wave that is generated at the time that the flow velocity of the two-phase refrigerant is changed from the supersonic velocity state to the subsonic velocity state can be a weak shock wave in terms of gas dynamics. Thus, the refrigerant pressure increasing performance in the diffuser portion 18*g* can effectively be restricted from becoming unstable.

As a result, according to the ejector-type refrigeration cycle 10*b* of this embodiment, even in the case where the downstream-side refrigerant of the first evaporator 15 flows into the nozzle portion 18*a* of the ejector 18, a COP can sufficiently be improved.

In this embodiment, the gas-liquid supply section is constructed of the liquid storage tank 19. Thus, the configuration of the cycle is restricted from being complicated, and the gas-liquid two-phase refrigerant can reliably flow into the nozzle portion 18*a* of the ejector 18 in an extremely simple configuration.

In the ejector-type refrigeration cycle 10*b* of this embodiment, the temperature type expansion valve as a variable throttle mechanism is adopted as the low-stage-side throttling device 16, and the refrigerant flowing out of a second evaporator 17 falls within a predetermined reference range. In other words, an opening degree of the low-stage-side throttling device 16 of this embodiment is adjusted such that the degree of superheat of the refrigerant flowing out of the second evaporator 17 becomes lower than or equal to a predetermined reference degree of superheat.

Accordingly, by appropriately setting the reference degree of superheat, the increase in the quality x of the mixed refrigerant can reliably be restricted, the injection refrigerant in the gas-liquid two-phase state and the suction refrigerant in the gas-phase state of which degree of superheat is lower than or equal to the reference degree of superheat, being mixed in the mixed refrigerant. Furthermore, the opening degree of the low-stage-side throttling device 16 may be adjusted such that the refrigerant flowing out of the second evaporator 17 becomes a saturated gas-phase refrigerant or the gas-liquid two-phase refrigerant.

In addition, according to the ejector 18 of this embodiment, similar to the first embodiment, the refrigerant pressure increasing performance in the diffuser portion 18*g* can be stabilized, and ejector efficiency $\eta ej$ in the ejector 18 can be improved. As a result, according to the ejector-type refrigeration cycle 10*b* of this embodiment, an effect in improving the COP that is achieved by including the ejector 18 can sufficiently be obtained.

Moreover, the ejector 18 that is disclosed in any of the second, the third, an eighth, and a ninth embodiments can be adopted in the ejector-type refrigeration cycle 10*b* of this embodiment.

Sixth Embodiment

Figure 13:
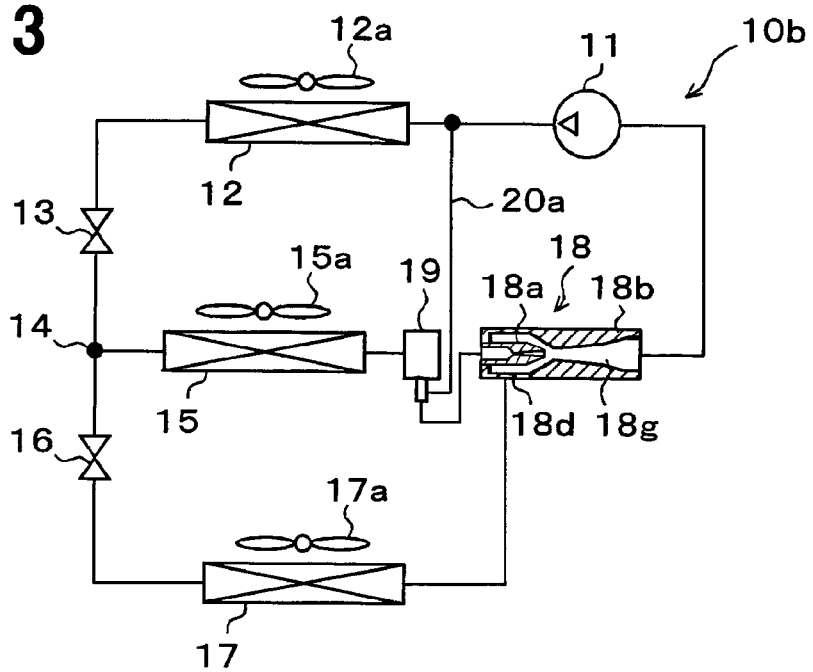
FIG. 13 is an overall configuration diagram illustrating an ejector-type refrigeration cycle of a sixth embodiment.

In this embodiment, a description will be made on an example in which a configuration of an ejector-type refrigeration cycle is changed from that in the fifth embodiment as shown in FIG. 13.

More specifically, in an ejector-type refrigeration cycle 10*b* of this embodiment, a discharged refrigerant passage 20*a* that guides a gas-phase refrigerant discharged from a compressor 11 into a liquid storage tank 19 is added. The discharged refrigerant passage 20*a* is desirably provided with throttle portion to suppress an increase in refrigerant pressure in the liquid storage tank 19. Accordingly, in this embodiment, the discharged refrigerant passage 20*a* is constructed of a capillary tube.

Thus, the liquid storage tank 19 that is a gas-liquid supply section of this embodiment is configured to mix a liquid-phase refrigerant stored in the liquid storage tank 19 and a gas-phase refrigerant discharged from the compressor 11 and to make the mixed refrigerant flow out to an inlet side of a nozzle portion 18*a*. The rest of the configuration and operation are the same as those in the fifth embodiment. Even when the gas-liquid supply section is configured as in this embodiment, the same effects as those of the fifth embodiment can be obtained.

Moreover, the ejector 18 that is disclosed in any of the second, the third, an eighth, and a ninth embodiments can be adopted in the ejector-type refrigeration cycle 10*b* of this embodiment.

Seventh Embodiment

Figure 14:
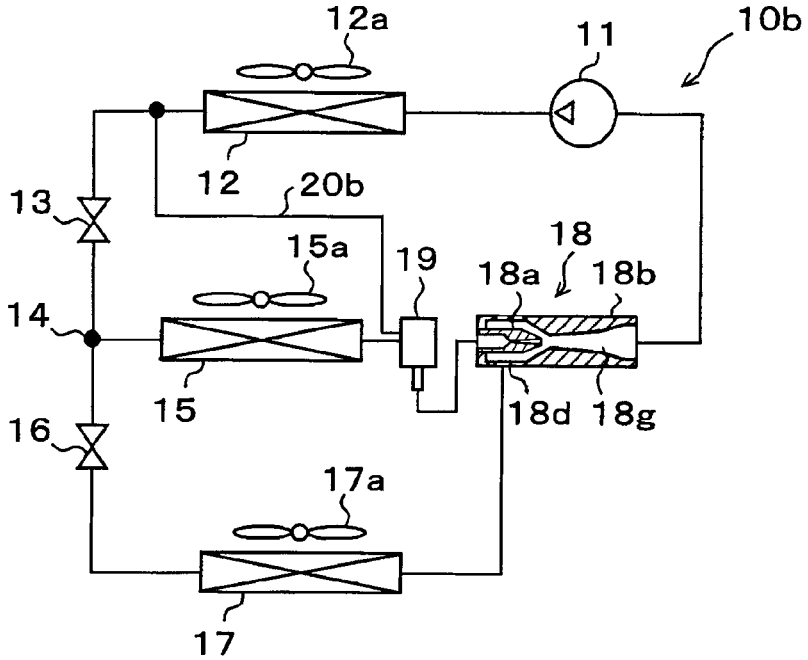
FIG. 14 is an overall configuration diagram illustrating an ejector-type refrigeration cycle of a seventh embodiment.

In this embodiment, a description will be made on an example in which a configuration of an ejector-type refrigeration cycle is changed from that in the fifth embodiment as shown in FIG. 14.

More specifically, in an ejector-type refrigeration cycle 10*b* of this embodiment, a condensed refrigerant passage 20*b* that guides a liquid-phase refrigerant flowing out of a radiator 12 into a liquid storage tank 19 is added. The condensed refrigerant passage 20*b* is desirably provided with a throttle section to suppress an increase in refrigerant pressure in the liquid storage tank 19. Accordingly, in this embodiment, the condensed refrigerant passage 20*b* is constructed of a capillary tube.

Thus, the liquid storage tank 19 that is a gas-liquid supply section of this embodiment is configured to mix the liquid-phase refrigerant flowing out of the radiator 12 and a gas-phase refrigerant flowing out of a first evaporator 15 and to make the mixed refrigerant flow out to an inlet side of a nozzle portion 18*a*. The rest of the configuration and operation are the same as those in the fifth embodiment. Even when the gas-liquid supply section is configured as in this embodiment, the same effects as those of the fifth embodiment can be obtained.

Moreover, the ejector 18 that is disclosed in any of the second, the third, an eighth, and a ninth embodiments can be adopted in the ejector-type refrigeration cycle 10*b* of this embodiment.

Eighth Embodiment

Figure 15:
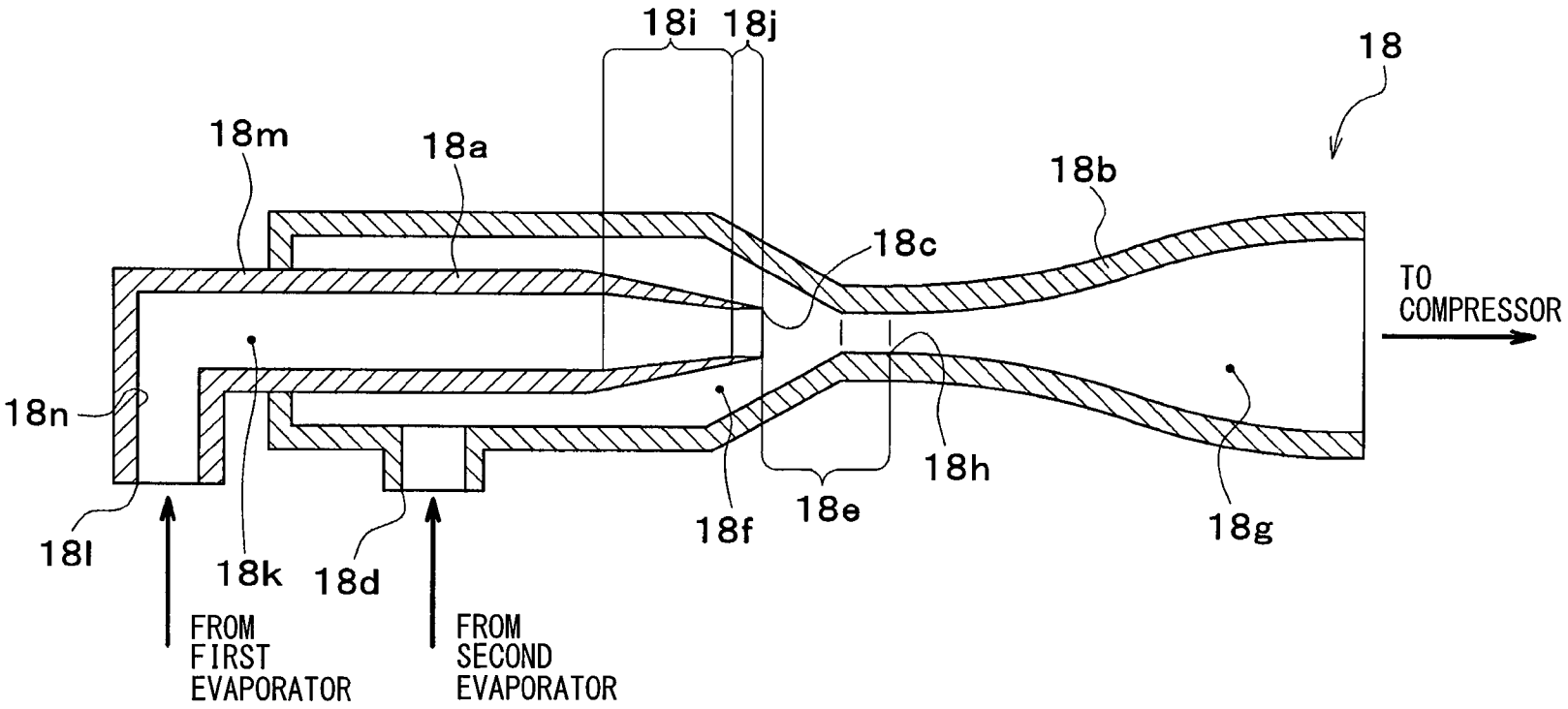
FIG. 15 is an axial cross-sectional view illustrating an ejector of an eighth embodiment.

In this embodiment, as shown in FIG. 15, similar to the third embodiment, a swirl space 18*k* in which the refrigerant flowing out of a refrigerant inlet port 18*l* swirls is provided on the inside of a cylindrical section 18*m* that is provided on an upstream side in a nozzle portion 18*a* in the refrigerant flow direction, with respect to the ejector 18 of the second embodiment. Configurations and operation of the rest of the ejector 18 and an ejector-type refrigeration cycle 10 are similar to those of the second embodiment.

Thus, when the ejector-type refrigeration cycle 10 of this embodiment is operated, similar to the second embodiment, vehicle cabin inside air that is blown into a vehicle interior and box inside air that is circulated and blown into a cool box can be cooled.

In addition, in the ejector 18 of this embodiment, similar to the third embodiment, the refrigerant swirls in the swirl space 18*k*. Accordingly, a gas-liquid two-phase refrigerant in which a condensation nucleus is generated can flow into the nozzle portion 18*a*, and nozzle efficiency $\eta noz$ can thereby be improved. Thus, deterioration of refrigerant pressure increasing performance in a diffuser portion 18*g* can be restricted.

Furthermore, similar to the second embodiment, an injection refrigerant is expanded freely. Accordingly, an increase in wall surface friction can be restricted. Thus, the deterioration of the refrigerant pressure increasing performance of the ejector 18 can be restricted by reducing energy loss of the refrigerant in the nozzle portion 18*a*.

Moreover, similar to the first embodiment, the refrigerant pressure increasing performance in the diffuser portion 18*g* can be stabilized, and ejector efficiency ηej in the ejector 18 can be improved. Thus, in the ejector-type refrigeration cycle 10 of this embodiment, an effect in improving a COP that is achieved by including the ejector 18 can sufficiently be obtained.

Ninth Embodiment

Figure 16:
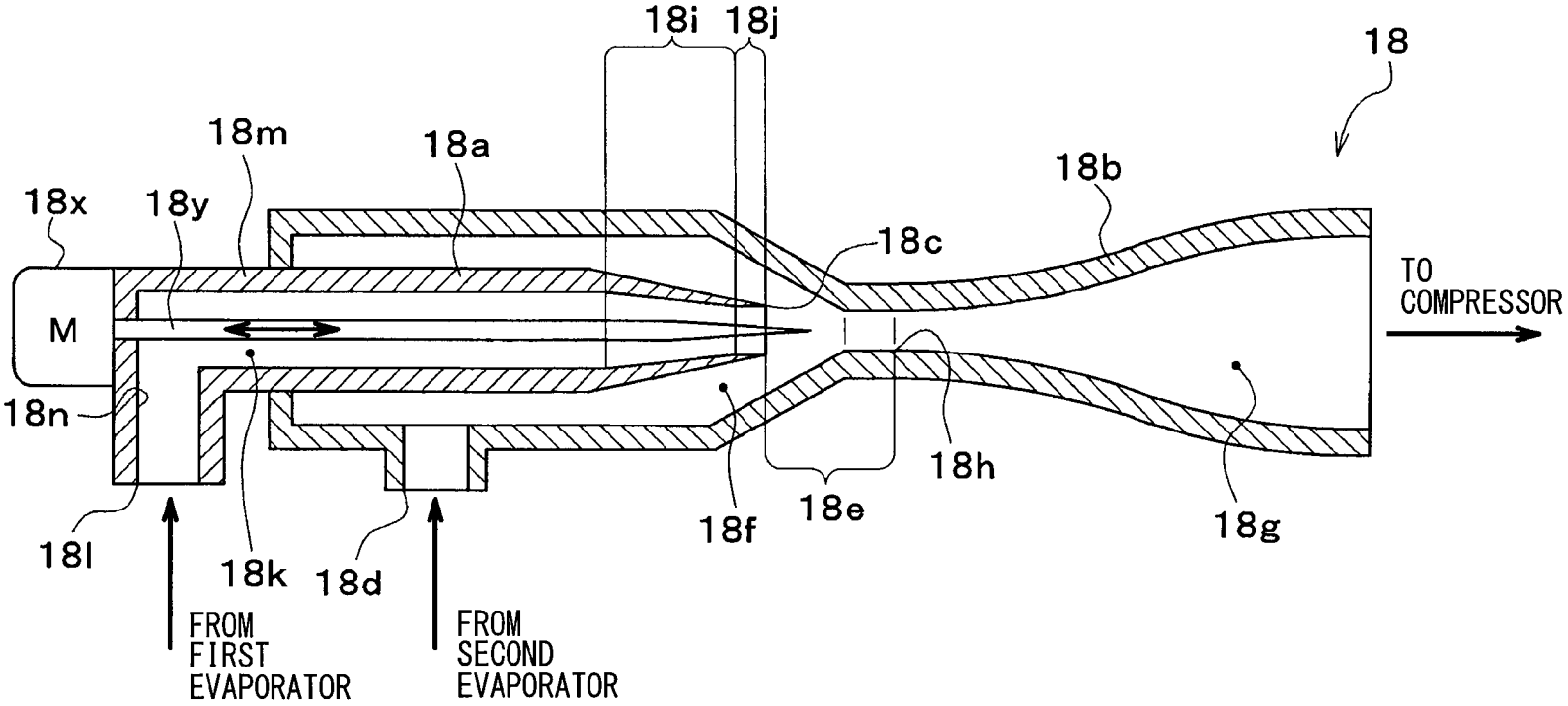
FIG. 16 is an axial cross-sectional view illustrating an ejector of a ninth embodiment.

In the eighth embodiment, a fixed nozzle, in which a refrigerant passage cross-sectional area of a minimum passage cross-sectional area section formed in an inlet section of an injecting section 18*j* is fixed, is adopted as the nozzle portion 18*a* of the ejector 18. In this embodiment, as shown in FIG. 16, a variable nozzle that is configured to be capable of changing the refrigerant passage cross-sectional area of the minimum passage cross-sectional area section is adopted.

More specifically, an ejector 18 of this embodiment has (i) a needle valve 18*y* as a valve body that varies the refrigerant passage cross-sectional area of a nozzle portion 18*a* and (ii) a stepping motor 18*x* as a drive section that displaces the needle valve 18*y*.

The needle valve 18*y* is formed in a needle shape of which center axis is coaxially arranged with a center axis of the nozzle portion 18*a*. More specifically, the needle valve 18*y* is formed in a tapered shape toward a downstream side in the refrigerant flow direction, and is arranged such that a tapered tip on the lowermost downstream side is projected toward the downstream side in the refrigerant flow direction of a refrigerant injection port 18*c* of the nozzle portion 18*a*. That is, the nozzle portion 18*a* of this embodiment is constructed as a so-called plug nozzle.

The stepping motor 18*x* is arranged on a refrigerant inlet port 18I side of the nozzle portion 18*a* and displaces the needle valve 18*y* in an axial direction of the nozzle portion 18*a*. In this way, a cross-sectional area of the refrigerant passage that is formed between an inner circumferential wall surface of the nozzle portion 18*a* and an outer circumferential wall surface of the needle valve 18*y* and that has an annular cross section is changed. Operation of the stepping motor 18*x* is controlled by a control signal output from a control device.

Configurations and operation of the rest of the ejector 18 and an ejector-type refrigeration cycle 10 are similar to those of the eighth embodiment. Thus, in the ejector-type refrigeration cycle 10 and the ejector 18 of this embodiment, similar effects as those of the eighth embodiment can be obtained.

In addition, according to the ejector 18 of this embodiment, the nozzle portion 18*a* is constructed as the variable nozzle. Thus, a refrigerant flow rate that corresponds to a load of the ejector-type refrigeration cycle 10 can flow into the nozzle portion 18*a* of the ejector 18.

Furthermore, since the nozzle portion 18*a* of this embodiment is constructed as the plug nozzle, an injection refrigerant can be injected from the refrigerant injection port 18*c* to a mixing portion 18*e* along an outer surface of the needle valve 18*y*. Thus, the injection refrigerant can easily be expanded freely even when the refrigerant flow rate flowing into the nozzle portion 18*a* is changed, and loss of kinetic energy of the refrigerant that flows through the refrigerant passage can be restricted by reducing wall surface friction between the refrigerant and the refrigerant passage.

Moreover, as shown in FIG. 16, the needle valve 18*y* of this embodiment is arranged to penetrate the inside of a swirl space 18*k*. Thus, a condensation nucleus is easily generated by friction between the refrigerant that swirls in the swirl space 18*k* and an inner wall surface of the nozzle portion 18*a*.

Figure 17:
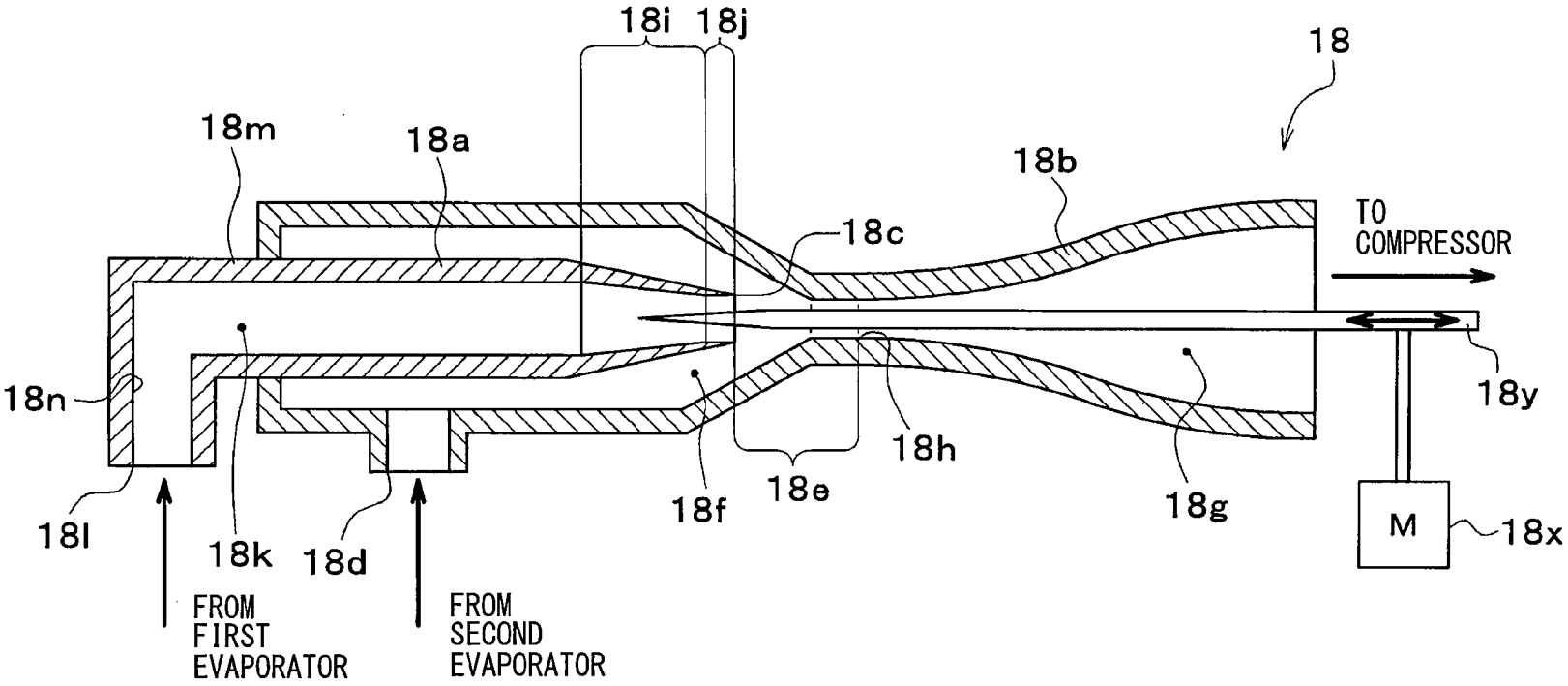
FIG. 17 is an axial cross-sectional view illustrating an ejector of a modified example of the ninth embodiment.

In the nozzle portion 18*a* depicted in FIG. 16, the valve in the tapered shape toward the downstream side in the refrigerant flow direction is adopted as the needle valve 18*y*. However, as in a modified example depicted in FIG. 17, a valve in a shape that is tapered from a diffuser portion 18*g* side toward an upstream side in the refrigerant flow direction may be adopted. In this case, the needle valve 18*y* only needs to be arranged such that a tapered tip on the uppermost stream side is projected to a tapered section 18*i* side from an injecting section 18*j*.

Tenth Embodiment

Figure 18:
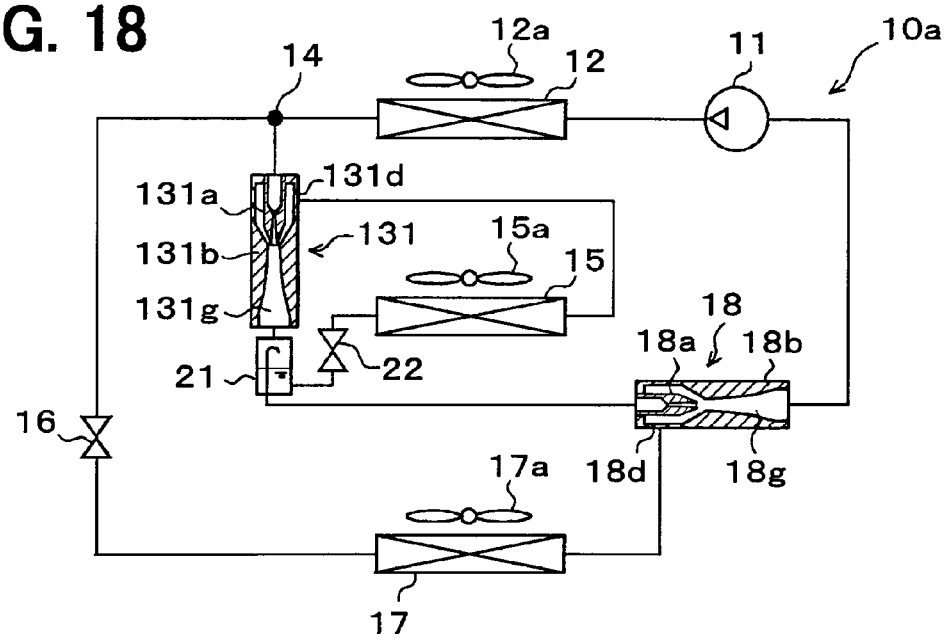
FIG. 18 is an overall configuration diagram illustrating an ejector-type refrigeration cycle of a tenth embodiment.

In this embodiment, a description will be made on an example in which a configuration of an ejector-type refrigeration cycle 10*a* is changed from that in the fourth embodiment. More specifically, in the ejector-type refrigeration cycle 10*a* of this embodiment, as shown in FIG. 18, a high-stage-side ejector 131 is adopted as a first pressure reduction section, instead of the high-stage-side throttling device 13.

A basic configuration of the high-stage-side ejector 131 is similar to that of the above-described ejector 18. Thus, similar to the ejector 18, the high-stage-side ejector 131 also has a high-stage-side nozzle portion 131*a* and a high-stage-side body portion 131*b*. The high-stage-side nozzle portion 131*a* decompresses a refrigerant. The high-stage-side body portion 131*b* is formed with (i) a high-stage-side refrigerant suction port 131*d* that draws the refrigerant flowing out of a first evaporator 15 and (ii) a high-stage-side diffuser portion (i.e., high-stage-side pressure increase portion) 131*g* that increases pressure of a mixed refrigerant.

A liquid-phase refrigerant that has been condensed in a radiator 12 can flow into the high-stage-side nozzle portion 131*a* of the high-stage-side ejector 131 according to this embodiment. Accordingly, in the high-stage-side ejector 131, a case where the high-stage-side diffuser portion 131*g* is incapable of exerting desired pressure increasing performance due to a flow of a gas-liquid two-phase refrigerant with a high quality into the high-stage-side nozzle portion 131*a* does not occur.

For this reason, in this embodiment, instead of an ejector that has exactly the same configuration as the above-described ejector 18, an ejector that is set to be capable of exerting a high COP as the entire ejector-type refrigeration cycle 10*a* at a time that the liquid-phase refrigerant flows into the high-stage-side nozzle portion 131*a* is adopted as the high-stage-side ejector 131.

A gas-liquid separator 21 that separates the refrigerant flowing out of the high-stage-side diffuser portion 131*g* of the high-stage-side ejector 131 into liquid-phase refrigerant and gas-phase refrigerant is connected to an outlet side of the high-stage-side diffuser portion 131*g* of the high-stage-side ejector 131.

A refrigerant inlet port of the first evaporator 15 is connected to a liquid-phase refrigerant outlet port of the gas-liquid separator 21 via a fixed throttle 22. A refrigerant suction port of the high-stage-side ejector 131 is connected to a refrigerant outlet port of the first evaporator 15. Meanwhile, an inlet side of a nozzle portion 18*a* of the ejector 18 is connected to a gas-phase refrigerant outlet port of the gas-liquid separator 21. The rest of the configuration is the same as that in the fourth embodiment.

Accordingly, when the ejector-type refrigeration cycle 10*a* of this embodiment is operated, a flow of the liquid-phase refrigerant flowing out of the radiator 12 is branched in a branch part 14. One of the refrigerants that have been branched in the branch part 14 flows into the high-stage-side nozzle portion 131*a* of the high-stage-side ejector 131 and is injected after pressure thereof is reduced in an isentropic manner.

Then, by a suction action of the injection refrigerant, the refrigerant flowing out of the first evaporator 15 is suctioned from the high-stage-side refrigerant suction port 131*d* of the high-stage-side ejector 131. A mixed refrigerant of the injection refrigerant injected from the high-stage-side nozzle portion 131*a* and the suction refrigerant suctioned from the high-stage-side refrigerant suction port 131*d* flows into the high-stage-side diffuser portion 131*g*, and pressure thereof is increased.

The refrigerant flowing out of the high-stage-side diffuser portion 131*g* flows into the gas-liquid separator 21 and is separated into the gas and the liquid. The liquid-phase refrigerant that has been separated in the gas-liquid separator 21 flows into the first evaporator 15 via the fixed throttle 22. Meanwhile, the gas-phase refrigerant that has been separated in the gas-liquid separator 21 flows into the nozzle portion 18*a* of the ejector 18. The rest of the operation is the same as that in the fourth embodiment.

Thus, according to the ejector-type refrigeration cycle 10*a* of this embodiment, not only similar effects as those of the fourth embodiment can be obtained, but also consumed power by the compressor 11 can be reduced by a pressure increasing action of the high-stage-side ejector 131. Therefore, the COP as the entire cycle can further be improved.

The ejector-type refrigeration cycle 10*a* in which the high-stage-side ejector 131 is adopted as the first pressure reduction section is not limited to the cycle configuration depicted in FIG. 18. However, the ejector-type refrigeration cycle 10*a* may be configured as shown in FIG. 19.

Figure 19:
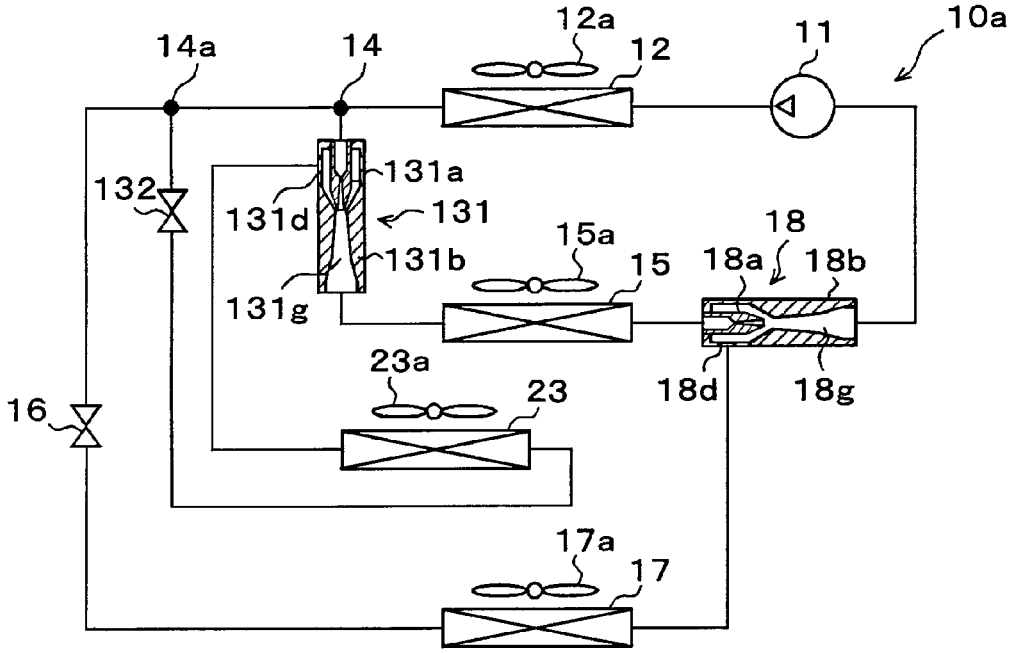
FIG. 19 is an overall configuration diagram illustrating an ejector-type refrigeration cycle of a modified example of the tenth embodiment.

More specifically, in the ejector-type refrigeration cycle 10*a* depicted in FIG. 19, the refrigerant inlet side of the first evaporator 15 is connected to the outlet side of the high-stage-side diffuser portion 131*g* of the high-stage-side ejector 131. Furthermore, a second branch part 14*a* that further branches the refrigerant flow is connected to the other refrigerant outlet port of the branch part (i.e., a first branch part) 14.

A refrigerant inlet port of a third evaporator 23 is connected to a refrigerant outlet port of the second branch part 14*a* via a fixed throttle 132. A high-stage-side refrigerant suction port 131*d* of the high-stage-side ejector 131 is connected to a refrigerant outlet port of the third evaporator 23. The third evaporator 23 is a heat-absorbing heat exchanger that evaporates a low-pressure refrigerant so as to exert a heat absorbing effect by exchanging heat between the low-pressure refrigerant of which pressure has been reduced in the fixed throttle 132, and air blown from a third blower fan 23*a*.

A refrigerant inlet port of the second evaporator 17 is connected to the other refrigerant outlet port of the second branch part 14*a* via the low-stage-side throttling device 16. The rest of the configuration is the same as that in the fourth embodiment. Also with such a cycle configuration, the COP as the entire cycle can further be improved by the pressure increasing action of the high-stage-side ejector 131.

Other Embodiments

Although the present disclosure is not limited to the above-described embodiments, various modifications can be made thereto as follows within a scope that does not depart from the gist of the present disclosure.

(1) In the above-described embodiments, the examples in which any of the ejector-type refrigeration cycles 10, 10*a*, 10*b* that include the ejector 18 is used as the vehicular refrigeration cycle device, the vehicle cabin inside air is cooled in the first evaporator 15, and the box inside air is cooled in the second evaporator 17 have been described. However, application of each of the ejector-type refrigeration cycles 10, 10*a*, 10*b* is not limited thereto.

For example, in the case where any of the ejector-type refrigeration cycles 10, 10*a*, 10*b* is used as the vehicular refrigeration cycle device, front seat air to be blown to a vehicle front seat side may be cooled in the first evaporator 15, and rear seat air to be blown to a vehicle rear seat side may be cooled in the second evaporator 17.

In addition, for example, in the case where any of the ejector-type refrigeration cycles 10, 10*a*, 10*b* is applied to a refrigeration and freezer device, refrigeration chamber air to be blown to a refrigeration chamber for refrigerating and storing food, beverages, and the like at a low temperature (more specifically, 0° C. to 10° C.) may be cooled in the first evaporator 15, and freezer chamber air to be blown to a freezer chamber for freezing and storing food and the like at an extremely low temperature (more specifically, −20° C. to −10° C.) may be cooled in the second evaporator 17.

(2) In the above-described embodiments, the examples in which the ejector 18 is applied to the ejector-type refrigeration cycles 10, 10*a*, 10*b* have been described. However, the cycle configurations to which the ejector 18 can be applied are not limited thereto.

For example, in each of the ejector-type refrigeration cycles 10, 10*a*, 10*b*, an accumulator that separates the refrigerant flowing out of the diffuser portion 18*g* into gas and a liquid and makes the separated gas-phase refrigerant flow out to the suction port side of the compressor 11 may be arranged between the outlet side of the diffuser portion 18*g* of the ejector 18 and the suction port side of the compressor 11.

In addition, a liquid receiver that separates the refrigerant flowing out of the radiator 12 into gas and a liquid and makes the liquid-phase refrigerant flow out to the downstream side may be arranged on the refrigerant outlet side of the radiator 12. Furthermore, an internal heat exchanger that exchanges heat between the high-temperature refrigerant flowing out of the radiator 12 and the low-temperature refrigerant to be suctioned into the compressor 11 may be arranged. Moreover, an auxiliary pump for pressure-feeding the refrigerant may be provided between the refrigerant outlet side of the second evaporator 17 and the refrigerant suction port 18*d* of the ejector 18.

(3) In the above-described embodiments, the examples in which as the high-stage-side throttling device 13 and, as the low-stage-side throttling device 16, the temperature type expansion valve, the fixed throttle, and the high-stage-side ejector are adopted have been described. However, an electric variable throttle mechanism that has (i) a valve body configured to be capable of changing an opening degree and (ii) an electric actuator including a stepping motor changing the opening degree of the valve body may be adopted as the high-stage-side throttling device 13 and the low-stage-side throttling device 16.

In the above-described embodiments, the example in which the radiator constructed of the heat exchanging unit that exchanges heat between the discharged refrigerant from the compressor 11 and the outside air is adopted as the radiator 12 has been described. However, a so-called subcooling condenser that has a condenser, a modulator section, and a subcooling portion may be adopted as the radiator 12. The condenser exchanges heat between the discharged refrigerant from the compressor 11 and the outside air, so as to condense the discharged refrigerant from the compressor 11. The modulator section separates the refrigerant flowing out of the condenser into gas and a liquid. The subcooling portion exchanges heat between a liquid-phase refrigerant flowing out of the modulator section and the outside air, so as to subcool the liquid-phase refrigerant.

In addition, in the above-described embodiments, the examples in which the components such as the body portion 18*b* of the ejector 18 are formed of metal have been described. However, a material is not limited as long as the function of each of the components can be exerted. That is, these components may be formed of resins.

(4) In the above-described embodiments, the examples in which the refrigerant passage cross-sectional area of the inlet section 18*h* of the diffuser portion 18*g* is set smaller than the refrigerant passage cross-sectional area of the refrigerant injection port 18*c* of the nozzle portion 18*a* have been described. However, more specifically, the opening diameter of the refrigerant injection port 18*c* may only need to be set smaller than the opening diameter of the inlet section 18*h*.

In addition, in the case where the opening diameter of the inlet section 18*h* is set larger than the opening diameter of the refrigerant injection port 18*c*, the refrigerant passage cross-sectional area of the inlet section 18*h* may be set smaller than the refrigerant passage cross-sectional area of the refrigerant injection port 18*c* by providing a projecting section that is projected toward the inside of the refrigerant passage in the inlet section 18*h*.

(5) In the above-described ninth embodiment, the example in which the refrigerant passage cross-sectional area of the minimum passage cross-sectional area section of the refrigerant passage formed in the nozzle portion 18*a* can be changed by the valve body (i.e., the needle body 18*y*) has been described. However, a configuration in which a conical valve body that extends from the refrigerant passage formed in the nozzle portion 18*a* to the inside of the diffuser portion 18*g* may be adopted as the valve body and in which the refrigerant passage cross-sectional area of the diffuser portion 18*g* is changed at the same time as that of the minimum passage cross-sectional area section of the nozzle portion 18*a* may be adopted.

(6) In the above-described embodiment, the example in which R-134a is adopted as the refrigerant has been described. However, the refrigerant is not limited thereto. For example, R-600a, R-1234yf, R-410A, R-404A, R-32, R-1234yfxf, R-407C, or the like may be adopted. Alternatively, a mixed refrigerant in which plural types of these refrigerants are mixed or the like may be adopted.

(7) The features disclosed in each of the above embodiments may appropriately be combined within a range that can be implemented. For example, the gas-liquid supply section described in the fifth to the seventh embodiment may be applied to the ejector-type refrigeration cycle 10*a* described in the fourth embodiment. For example, the ejector 18 that is disclosed in any of the second, the third, the eighth, and the ninth embodiments can be applied as the ejector 18 of the ejector-type refrigeration cycle 10*a* of the tenth embodiment.

(8) In the above-described embodiments, the radiator 12 is used as an exterior heat exchanger that exchanges heat between the refrigerant and the outside air, and the first, second evaporators 15, 17 are used as an interior heat exchanger that cool the air. However, reversely, the present disclosure may be applied to a heat pump cycle in which the first, second evaporators 15, 17 are constructed as the exterior heat exchangers that absorb heat from a heat source such as the outside air and in which the radiator 12 is constructed as the interior heat exchanger that heats the fluid to be heated, such as the air and water.

What is claimed is:

1. An ejector for a vapor compressional refrigeration cycle device that has a first evaporator and a second evaporator evaporating a refrigerant, the ejector comprising:

a nozzle portion that decompresses the refrigerant flowing out of the first evaporator until the refrigerant becomes a gas-liquid two-phase state, the nozzle portion injecting the refrigerant as an injection refrigerant from a refrigerant injection port;

a body portion;

a refrigerant suction port that is provided in the body portion and draws a refrigerant flowing out of the second evaporator as a suction refrigerant by a suction action of the injection refrigerant;

a pressure increase portion that is provided in the body portion and increases pressure of a mixed refrigerant of the injection refrigerant and the suction refrigerant; and a mixing portion that is provided in an area from the refrigerant injection port to an inlet section of the pressure increase portion in an internal space of the body portion, the mixing portion mixing the injection refrigerant and the suction refrigerant, wherein a distance from the refrigerant injection port to the inlet section in the mixing portion is determined such that a flow velocity of the refrigerant flowing into the inlet section becomes lower than or equal to a two-phase sound velocity, the nozzle portion has an inlet that is connected to a liquid storage section, the liquid storage section being disposed in the vapor compressional refrigeration cycle and storing a surplus refrigerant in the vapor compressional refrigeration cycle, a gas-liquid two phase refrigerant flowing out of the liquid storage section, the liquid storage section has an inlet directly connected to a refrigerant outlet of the first evaporator and an outlet connected to the inlet of the nozzle portion, and the gas-liquid two phase refrigerant flowing out of the liquid storage section flows into the inlet of the nozzle portion.

2. The ejector according to claim 1, wherein when the distance from the refrigerant injecting port to the inlet section in the mixing portion is referred to as La, and when a diameter of a circle is referred to as φDa, the circle that is converted as a circle of which area has a total value of (i) an opening cross-sectional area of the refrigerant injection port and (ii) a refrigerant passage cross-sectional area of a suction passage through which the suction refrigerant flows, the circle being converted in a cross section, perpendicular to an axial direction, of the nozzle portion including the refrigerant injection port, and the following formula is satisfied:

$$La/\varphi Da \leq 1.$$

3. The ejector according to claim 1, wherein as a refrigerant passage formed in the nozzle portion, a tapered section, in which a refrigerant passage cross-sectional area gradually decreases toward a downstream side in a refrigerant flow direction, and an injecting section that guides the refrigerant from the tapered section to the refrigerant injection port are provided, and the nozzle portion is formed to freely expand the injection refrigerant that is injected to the mixing portion by setting an expanding angle of the injecting section in an axial cross section to be larger than or equal to 0° such that an inner diameter of the injecting section is fixed or gradually increases toward the downstream side in the refrigerant flow direction.

4. The ejector according to claim 1, wherein the mixing portion has a shape in which the refrigerant passage cross-sectional area decreases toward the downstream side in the refrigerant flow direction.

5. The ejector according to claim 1, wherein the mixing portion has a shape that is defined by a combination of (i) a truncated cone shape in which the refrigerant passage cross-sectional area gradually decreases toward the downstream side in the refrigerant flow direction and (ii) a columnar shape in which the refrigerant passage cross-sectional area is fixed.

6. The ejector according to claim 5, wherein when an axial length of the nozzle portion in a columnar-shaped portion of the mixing portion is referred to as Lb, and a diameter of the columnar-shaped portion is referred to as φDb, the following formula is satisfied:

$$Lb/\varphi Db \leq 1.$$

7. The ejector according to claim 1, wherein a refrigerant passage cross-sectional area of the inlet section is set smaller than a refrigerant passage cross-sectional area of the refrigerant injection port.

8. The ejector according to claim 1, further comprising a swirl space forming member that forms a swirl space in which the refrigerant flowing into the nozzle portion swirls around an axis of the nozzle portion.

9. The ejector according to claim 1, further comprising a valve body changing the refrigerant passage cross-sectional area of the nozzle portion.

10. An ejector for a vapor compressional refrigeration cycle device that includes a first evaporator and a second evaporator evaporating a refrigerant, the ejector comprising:

a nozzle portion that decompresses the refrigerant flowing out of the first evaporator until the refrigerant becomes a gas-liquid two-phase state, the nozzle portion injecting the refrigerant as an injection refrigerant from a refrigerant injection port;

a body portion;

a refrigerant suction port that is provided in the body portion and draws a refrigerant flowing out of the second evaporator as a suction refrigerant by a suction action of the injection refrigerant;

a pressure increase portion that is provided in the body portion and increases pressure of a mixed refrigerant of the injection refrigerant and the suction refrigerant; and a mixing portion that is provided in an area from the refrigerant injection port to an inlet section of the pressure increase portion in an internal space of the body portion, the mixing portion mixing the injection refrigerant and the suction refrigerant, wherein as a refrigerant passage formed in the nozzle portion, (i) a tapered section in which a refrigerant passage cross-sectional area gradually decreases toward a downstream side in the refrigerant flow direction and (ii) an injecting section that guides the refrigerant from the tapered section to the refrigerant injection port are provided, the nozzle portion is formed to freely expand the injection refrigerant that is injected to the mixing portion by setting an expanding angle of the injecting section in an axial cross section to be larger than or equal to 0°, the nozzle portion has an inlet that is connected to a liquid storage section, the liquid storage section being disposed in the vapor compressional refrigeration cycle and storing a surplus refrigerant in the vapor compressional refrigeration cycle, a gas-liquid two phase refrigerant flowing out of the liquid storage section, the liquid storage section has an inlet directly connected to a refrigerant outlet of the first evaporator and an outlet connected to the inlet of the nozzle portion, and the gas-liquid two phase refrigerant flowing out of the liquid storage section flows into the inlet of the nozzle portion.

* * * * *